US009027771B2

(12) United States Patent
Metcalfe et al.

(10) Patent No.: US 9,027,771 B2
(45) Date of Patent: May 12, 2015

(54) BEVERAGE AND FOOD CARRIER AND DISPENSING SYSTEMS THEREFOR

(71) Applicant: Blue Shoe Innovations, LLC, Solon, OH (US)

(72) Inventors: Paul R. Metcalfe, Solon, OH (US); Scott E. Urban, Cleveland, OH (US); Anil V. Singaraju, Brunswick, OH (US); Mark A. Gamble, Bay Village, OH (US)

(73) Assignee: Blue Shoe Innovations, LLC, Solon, OH (US)

( * ) Notice: Subject to any disclaimer, the term of this patent is extended or adjusted under 35 U.S.C. 154(b) by 0 days.

(21) Appl. No.: 13/839,990

(22) Filed: Mar. 15, 2013

(65) Prior Publication Data

US 2013/0206615 A1 Aug. 15, 2013

Related U.S. Application Data

(62) Division of application No. 12/403,886, filed on Mar. 13, 2009.

(60) Provisional application No. 61/036,314, filed on Mar. 13, 2008.

(51) Int. Cl.

| | |
|---|---|
| ***B65D 81/00*** | (2006.01) |
| ***B65D 71/50*** | (2006.01) |
| ***B65D 83/08*** | (2006.01) |
| ***B65D 33/00*** | (2006.01) |

(52) U.S. Cl.

CPC ..... *B65D 81/00* (2013.01); *B65D 71/508* (2013.01); *B65D 83/0805* (2013.01); *B65D 33/00* (2013.01)

(58) Field of Classification Search

USPC ..... 206/507, 562

See application file for complete search history.

(56) References Cited

U.S. PATENT DOCUMENTS

| | | | | |
|---|---|---|---|---|
| 2,823,828 | A * | 2/1958 | Frater | 206/507 |
| 2,995,271 | A * | 8/1961 | Frater et al. | 206/507 |
| 3,191,796 | A * | 6/1965 | Schwartz et al. | 220/23.6 |
| 3,323,706 | A | 6/1967 | Gereke | |
| 3,744,704 | A | 7/1973 | Struble | |
| 3,780,906 | A | 12/1973 | Katzenmeyer | |
| 3,931,948 | A | 1/1976 | Mason, Jr. | |
| 4,155,502 | A | 5/1979 | Forte | |
| 4,183,444 | A | 1/1980 | English et al. | |
| 4,196,807 | A | 4/1980 | Brom | |
| 4,461,396 | A | 7/1984 | Harper | |
| 4,478,346 | A | 10/1984 | Spong | |
| 4,545,480 | A | 10/1985 | Klygis | |

(Continued)

OTHER PUBLICATIONS

Sinn Frei.com, Coffe Bag—Die Tragetasche für den Kaffee, web page: http://www.sinn-frei.com/coffe-bag-die-tragetasche-fuer-den-kaffee_7142.htm#kommentare, May 1, 2008, 4 pages—Applicant not aware of any prior publications relating to this product.

*Primary Examiner* — Tri Mai
(74) *Attorney, Agent, or Firm* — Fay Sharpe LLP

(57) ABSTRACT

A carrier for carrying at least one beverage container includes a sheet of at least one layer of a polymeric material having an arrangement of at least one aperture for receiving a beverage container, and having a plurality of handle members for grasping by at least one finger or portion of a users hand for carrying the beverage container. A tray configuration is also provided for use with the carrier or in a separate manner, and a dispensing system for use with the carrier is set forth.

16 Claims, 31 Drawing Sheets

(56) References Cited

U.S. PATENT DOCUMENTS

| | | | | | |
|---|---|---|---|---|---|
| 4,732,274 | A | | 3/1988 | Bouton | |
| 4,823,958 | A | | 4/1989 | Mahmud | |
| 4,832,188 | A | | 5/1989 | Christie | |
| 4,938,373 | A | | 7/1990 | McKee | |
| 5,058,737 | A | | 10/1991 | Patterson et al. | |
| 5,060,820 | A | | 10/1991 | Boerner | |
| 5,085,391 | A | | 2/1992 | Berger et al. | |
| 5,110,170 | A | | 5/1992 | Boatwright | |
| 5,127,519 | A | | 7/1992 | Tsao | |
| 5,137,210 | A | | 8/1992 | Hibbs | |
| 5,176,283 | A | | 1/1993 | Patterson et al. | |
| 5,180,079 | A | | 1/1993 | Jeng | |
| 5,207,743 | A | | 5/1993 | Costarella et al. | |
| 5,234,125 | A | * | 8/1993 | Roberts | 220/574 |
| 5,249,700 | A | | 10/1993 | Dumke | |
| 5,267,644 | A | | 12/1993 | Tsao | |
| 5,292,028 | A | | 3/1994 | Patterson et al. | |
| 5,346,070 | A | | 9/1994 | McSpadden | |
| 5,361,905 | A | | 11/1994 | McQueeny et al. | |
| 5,429,262 | A | | 7/1995 | Sharkey | |
| 5,441,164 | A | | 8/1995 | Beck et al. | |
| 5,538,154 | A | | 7/1996 | Von Holdt | |
| 5,573,131 | A | | 11/1996 | Berjis | |
| 5,593,062 | A | | 1/1997 | Martin | |
| 5,695,052 | A | * | 12/1997 | Damato | 206/217 |
| 5,722,558 | A | | 3/1998 | Thompson | |
| 5,727,678 | A | | 3/1998 | Chen | |
| 5,738,217 | A | | 4/1998 | Hunter | |
| 5,797,486 | A | | 8/1998 | Picciolo | |
| D397,911 | S | | 9/1998 | Waldmann | |
| 5,843,501 | A | * | 12/1998 | Rubin et al. | 426/127 |
| 5,915,561 | A | * | 6/1999 | Lorenzana et al. | 206/562 |
| 5,927,502 | A | | 7/1999 | Hunter | |
| 5,954,195 | A | | 9/1999 | Krueger et al. | |
| 5,957,276 | A | | 9/1999 | Cutler | |
| 5,984,131 | A | * | 11/1999 | Krueger et al. | 220/574 |
| 6,183,027 | B1 | | 2/2001 | Tsao | |
| 6,202,836 | B1 | | 3/2001 | Picciolo | |
| 6,298,992 | B1 | | 10/2001 | Tsao | |
| 6,360,885 | B1 | * | 3/2002 | Krueger et al. | 206/217 |
| 6,425,480 | B1 | | 7/2002 | Krueger et al. | |
| 6,427,864 | B1 | | 8/2002 | Asselin | |
| 6,439,388 | B1 | * | 8/2002 | Lerner | 206/562 |
| 6,533,233 | B2 | | 3/2003 | Thomas | |
| 6,802,802 | B2 | | 10/2004 | Woog | |
| 6,827,207 | B1 | | 12/2004 | Chen | |
| 7,115,294 | B1 | * | 10/2006 | Loh et al. | 426/115 |
| 7,341,754 | B1 | | 3/2008 | Loh et al. | |
| 7,726,512 | B2 | * | 6/2010 | MacCarthy | 220/737 |
| 7,832,554 | B2 | | 11/2010 | Sutton-Rainey | |
| 8,672,175 | B2 | * | 3/2014 | Farmer | 220/737 |
| 2005/0045629 | A1 | | 3/2005 | Conarro et al. | |
| 2005/0241964 | A1 | | 11/2005 | Taylor | |
| 2008/0063759 | A1 | * | 3/2008 | Raymond et al. | 426/127 |
| 2008/0115413 | A1 | * | 5/2008 | Blackmore | 47/65.7 |
| 2008/0217207 | A1 | | 9/2008 | Hall | |
| 2009/0194543 | A1 | * | 8/2009 | Farmer | 220/575 |
| 2011/0139639 | A1 | | 6/2011 | Sutton-Rainey | |
| 2011/0272299 | A1 | | 11/2011 | Smith | |

* cited by examiner

BEVERAGE AND FOOD CARRIER AND DISPENSING SYSTEMS THEREFOR

CROSS REFERENCE TO RELATED APPLICATION

This application is a divisional of co-pending U.S. application Ser. No. 12/403,886 filed Mar. 13, 2009, which in turn claims the benefit of U.S. Provisional Application No. 61/036,314 filed on Mar. 13, 2008, all of which are hereby incorporated herein by reference.

SUMMARY OF THE DISCLOSURE

The invention relates to a beverage and/or food carrying device and dispensing systems therefore. More particularly, the invention relates to beverage and/or food carrying devices which allow easier handling of beverage and food items in many different environments and applications, where food and beverages are dispensed on an individual basis.

BACKGROUND OF THE INVENTION

In many environments and situations, the handling of food and beverages dispensed on an individual basis, becomes difficult and cumbersome. For example, in the environment such as a sporting or entertainment venue, food and beverages are dispensed via counters or vendors, on an individual basis. If a patron purchases food or beverages from the counter for example, they then must somehow carry the purchased items back to their seat, and handling of the items can be difficult. This is particularly true where the patron may buy multiple drinks and/or food items for their group.

Many other situations are similar, where a person gets drinks and/or food and then must carry the items back to a seat or the like for consumption. Such situations may include movie theaters, buffets, happy hours, or many other activities or environments, where a person has to carry food and beverages that are dispensed on an individual basis. Further, spillage of beverages from hand carried cups is a well known problem to customers of carry out or fast food restaurants. Also, handling multiple drinks is problematic. For such situations, there are drink carriers that are used, being the paper pulp type trays with multiple receptacles in which drinks can be frictionally engaged. Such trays as currently available for supporting and transporting drinking cups include receptacles sized to fit the bottom of a particular size cup. As the receptacles are typically formed in one size, this has led the fast food restaurants to configure the cups for different sizes of drinks to have the same bottom configuration, thereby allowing them to fit in the tray receptacle. These known carriers provide only limited lateral support for cups being carried or otherwise transported, increasing the chance that taller cups can be tipped and spilled while carrying. Further, such carriers are bulky and not conveniently configured to carry additional items, such as food items, making storage and handling of the tray more difficult. These particular types of tray devices are also difficult to carry, and usually require both hands of the user, preventing the user from using their hands to carry other things or perform tasks such as opening doors, handing a ticket to a person, or distributing food to another person.

Additionally, these types of carriers are unattractive, bulky, nested tightly together and therefore difficult to handle, expensive to ship and space-consuming to store at a site for use, taking up significant storage space due to their configuration. Other types of carriers may be made to assemble for use, making them inconvenient and difficult to handle.

Although helpful, such devices are still problematic if multiple drinks and food items are purchased, and are not convenient to carry or handle, ship or store for use.

Various other efforts have been made to facilitate the transportation of multiple beverage cups from a point of purchase to a point of use. Such efforts have generally not been accepted by consumers, due to various deficiencies, and there thus is a need for an improved device for handling beverages and food items that are dispensed on an individual basis.

Another problem inherent in existing container carriers is that they may not support filled cups in a stable manner. Known carriers when in use, may not allow for stable carrying as they are rigid, and therefore require the user to maintain the carrier in a level position to avoid spillage of the cup contents. Further, such carriers may be unstable if they are not filled with the maximum number of cups for which they are designed.

Notwithstanding the state of the art as described herein, there is a need for further improvements in beverage and food carriers, as well as dispensing systems for such carriers.

SUMMARY OF THE INVENTION

The invention provides a carrier for at least one beverage container. In one example of the invention, a carrier includes a sheet of at least one layer of a polymeric material having an arrangement of at least one aperture for receiving a beverage container and a plurality of handle members.

In another example of the invention, a carrier for carrying a plurality of beverage containers and a food product includes a first sheet of a polymeric material having a first side and a second side, wherein the first sheet has an arrangement of at least one aperture for receiving beverage containers and a plurality of handle members, and a second sheet of a polymeric material having an arrangement of at least one aperture for receiving a beverage container and a handle member, wherein the second sheet is attached to the first side of the first sheet such that the at least one aperture of the second sheet are aligned with the at least two apertures of the first sheet.

In yet another example of the invention, a dispensing system for a carrier for at least one beverage container is disclosed. The carrier includes a sheet of at least one layer of a polymeric material having an arrangement of at least one aperture for receiving a beverage container and a plurality of handle members. The dispensing system includes a box, the box having a plurality of walls defining a cavity. In general, the cavity includes a plurality of carriers that are removably positioned within the cavity. The box also includes an upper surface, wherein at least one opening on the upper surface provides for access to the cavity.

DETAILED DESCRIPTION OF THE INVENTION

Figure 1:
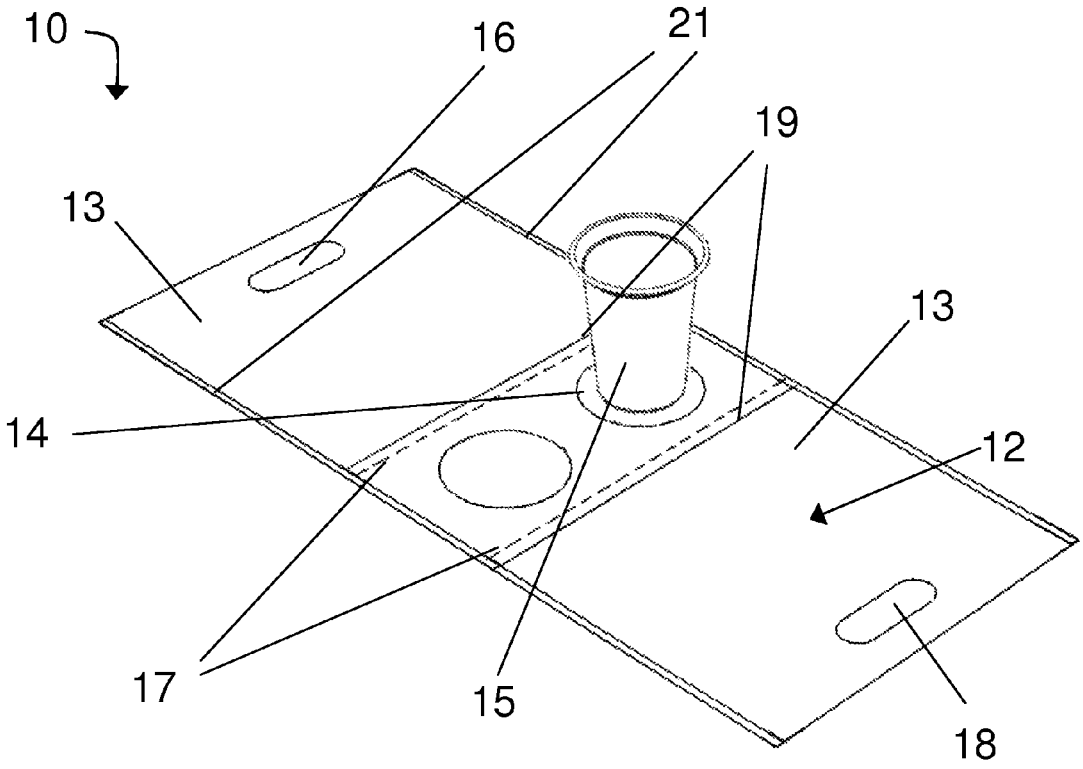
FIG. 1 is a perspective view of an example of a carrier according to the invention, showing the carrier in an unfolded state.
Figure 2:
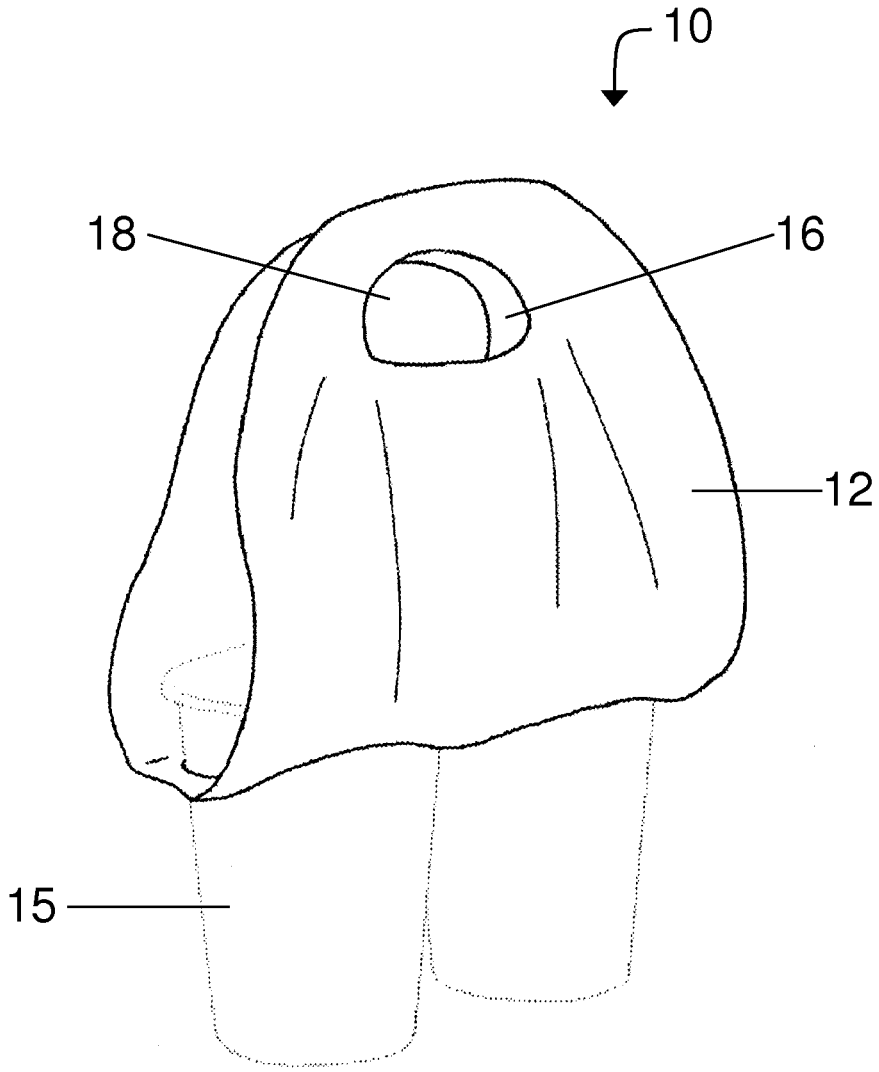
FIG. 2 is a perspective view of the example of the carrier for beverage containers shown in FIG. 1, showing the carrier in a folded state for use.

In one example of the invention, as seen in FIGS. 1 and 2, carrier 10 is formed as one or more sheets 12 of at least one layer of a polymeric material, having an arrangement of at least one aperture 14 for receiving a beverage container 15. It is also contemplated that the carrier 10 in this or other examples of the invention, may not have to have drink holes 14, thereby providing a sling carrier for carrying a wide variety of things such as food or other items. The sheet(s) 12 further comprises a plurality of handle members 16 and 18 for receiving the fingers of a person carrying carrier 10. If desired, the sheet(s) 12 of carrier 10 may be formed of multiple layers on one or both sides, including two or more layers of polymeric material, to enhance the strength of the carrier 10, and/or to provide sheet characteristics desired for carrying different sized containers of beverages. It is also possible to use two or more sheets 12 of material, on one or both sides of carrier 10 to form one or more carrying pockets 13 on one or both sides of the central drink holes 14. The pockets 13 may be formed by a plurality of heat seals or folds 21 forming the sides, and a plurality of heat seals 19 forming the bottom of the pockets 13. If pockets 13 are provided, they may be separable via optional perforated cuts 17 below the bottom heat seals 19 of the pocket. Upon separation, the pockets become separate bags or the like for carrying items. The sheet(s) 12 may be die-cut or otherwise suitably formed. It is thus contemplated that the sheet(s) 12 could be formed of different materials and/or multiple layers, to allow the inner sheet 12 to be formed as a thicker or stronger material to assist in carrying the load of cup(s) 15, while an outer sheet 12 could be formed of a thinner or different material that is less expensive for example.

In one example, the one or more sheets 12 are constructed of a flat, durable, flexible thermoplastic polymer. The thermoplastic polymer film may be of any suitable type, such as medium density polyethylene (MDPE) for example. In an example of the invention, sheet 12 is constructed of MDPE, which has desired strength characteristics for carrying typical beverage cups of different sizes and weights, and/or configurations. In this or other examples described below, the sheet also allows printing on one or both sides for branding, advertising, instructions, or other purposes.

As an example for some applications, the MDPE thermoplastic polymer has the benefits of providing properties that include limited stretchability and a substantially non-sticky texture to sheet 12. These properties allow carrier 10 to accommodate a range of beverage container sizes, shapes and fill weights. This material or a like material may thus provide strong securement of a beverage container or cup 15 in the aperture 14 when inserted into aperture 14. The material also may allow the diameter of aperture 14 of carrier 10 to be capable of increasing to a degree to accommodate the beverage container 15 based upon the size, shape and weight of the container 15. This property facilitates in securing the beverage container in carrier 10 during transport. In general, any suitable polymeric materials which are not excessively tacky and do not have a tendency to excessively stretch or tear when exposed to heavier than normal beverage containers, may be used. Further, materials which exhibit limited stretch properties and low tack allow for easy removal of beverage containers when required, thus promoting ease of handling and use of carrier 10.

Suitable materials such as MDPE or others may also possess the qualities of increased tensile strength in both the machine as well as the transverse direction in the manufacturing of carrier 10. The combination of increased tensile strength in addition to the limited stretchability of the material provides carrier 10 with the capability to bear the load of beverage containers, as well as other items such as food, without deforming excessively or failing. For example, the molecular arrangement in MDPE facilitates an increase in the tear resistance when compared to HDPE. The material from which carrier 10 is made may also be resistant to tearing, such as crease tearing which is described as the phenomena of a small tear propagating through the material once the material is exposed to further loads. Other suitable materials may be selected for various applications, and may include materials such as low density polyethylene (LDPE) and high density polyethylene (HDPE) for example, PLA (Polylactic Acid), paper, bamboo substrate, flashspun and bonded high-density polyethylene fibers, or a combination of paper and polymer or other combinations. Any suitable materials and combinations of materials are contemplated. As mentioned above, if two or more sheets are used, the different sheets could be formed of different materials to provide different characteristics such as strength, stretchability, cost, or others, as may be desired.

FIG. 2 illustrates container carrier 10 in a functional position. In use, carrier 10 is easily loaded when in the flat position by placement of beverage containers at the site of the hole(s) 14, as shown in FIG. 1, and then is temporarily secured in a folded state for carrying by at least one finger of a person's hand or other structure inserted through handle members 16 and 18. Upon lifting, the apertures 14 move upwardly on the containers 15 until the tapered side of the containers 15 are engaged by the apertures 14. The size of the apertures 14 are provided to have a somewhat larger diameter than the bottom of the container 15 so that they engage the tapered container at a position approximately between the midportion and top of the container 15 as shown. With different sized cups, this position of engagement with the cup is effectively maintained since larger, heavier cups will stretch the hole 14 more, and smaller, lighter cups will stretch the hole 14 less, allowing different sizes to be easily accommodated. This ensures that the center of gravity of the filled container is positioned approximately at or below the level at which the aperture 14 engages the container 15, providing stable securement of the container 15 therein, without the container 15 being able to tip from a substantially level position as shown. Once carrier 10 is in the functional position, the person can carry carrier 10 and the beverage container(s) 15 to a desired destination without the beverage containers tilting over and spilling the beverage from the containers. This is enabled by the flexibility of the material from which the carrier 10 is made, which allows the carrier to swing and deform between the container 15 and handles 16 and 18 when walking, while the containers 15 remain substantially level. The carrier 10 offers convenience in carrying one or more drinks, with one or two cups easily carried in a stable fashion due to the flexibility of the film from which carrier 10 is made, which keeps the filled cups substantially upright, even with variations of hand and/or hand-hole positions. The carrier is effectively self-stabilizing, distinct from the use of rigid materials which rigidly tie hand movement directly to cup movement, which is more inclined to cause spills of beverages. It should also be evident that the carrier 10 keeps the fingers free for other tasks when being carried, as only a portion of the fingers/hand is needed to support the carrier 10 via the handle members 16 and 18. The carrier 10 is also very light weight and economical to make due to the low cost of the film materials which may be used, and simple manufacturing process. In a further example, the handle portions 16 and 18 may be attachable to one another by any suitable mechanism, such as by either attaching all layers or just the inside layers, by adhesive or mechanical systems or the like. The attachment of the handle portions 16 and 18 to one another assists in allowing a loaded carrier 10 to stand upright and maintain a form to allow it to be placed on a support surface and picked up again easily. As will be further described below, the carriers according to examples are also easily and cost-effectively packaged for shipping, handling and storage at a site for use. After use, the carriers can be recycled or composted depending on the type of materials used, offering an environmentally friendly product. The size and characteristics of the product enables it to consume significantly less volume in the waste receptacles and waste management system than any other beverage carrier, making it environmentally and economically very attractive.

In the example of FIG. 1, the carrier 10 may have sheet(s) 12 formed by a simple die-cutting process, to form top edges that are square, or as shown in FIG. 2, the sheet(s) 12 may be formed to have top edges that are rounded or otherwise shaped differently than square. In examples, the sheet(s) 12 may be suitably formed by die-cutting, to eliminate the need to separately form a desired overall shape or trim the material of the carrier 10. In examples with pockets 13, the pockets 13 or saddle-bags may have heat seals 21 that run all the way up to the top or partially along the sides of the carrier 10. Further, one or more additional layers could be used to make additional compartments and/or compartment separators for the carrier 10. Such additional layer(s) could be localized to the area of one or both sides or carrier 10, or be provided as another full layer. One or more additional layers could be provided to add to support the cup(s) if desired. The layer or layers of carrier 10 can be of different thickness or of different types of plastic materials if desired. For example, a thicker and/or stiffer layer could be provided to facilitate support of the cups, while one or more other layers could be provided primarily for forming the pockets or saddle-bags 13, which could be of a thinner and more flexible and stretchable material. The carrier 10 could be constructed to use a thin handle layer and reinforce the handle openings 16 and 18 for example.

Figure 3:
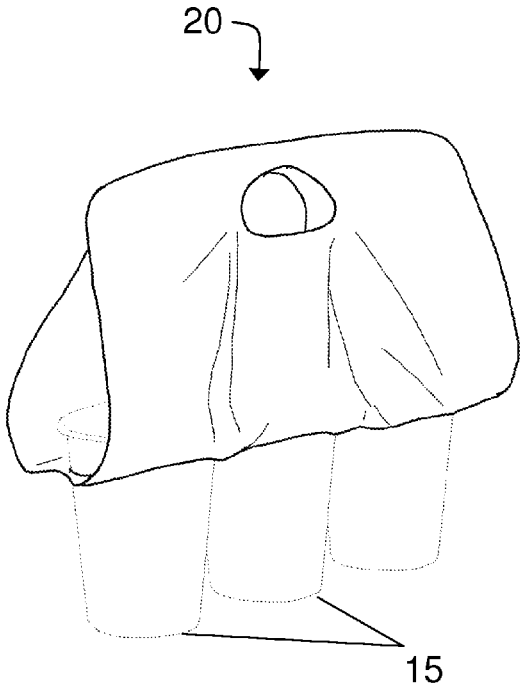
FIG. 3 is a perspective view of a further example of a carrier according to the invention, showing the carrier in a folded state.
Figure 3A:
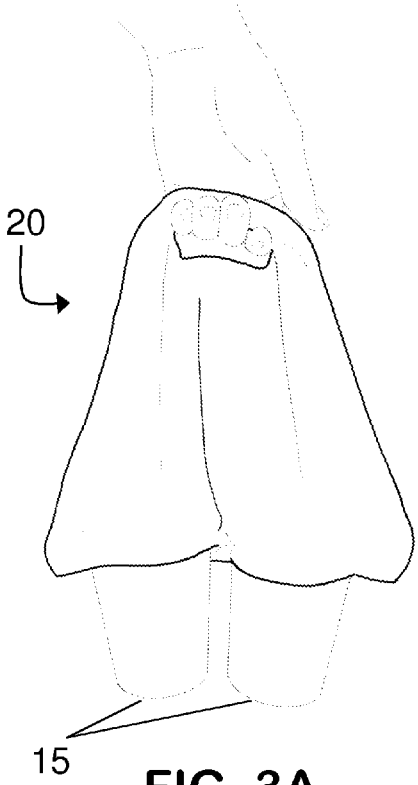
FIG. 3A is a perspective view of the carrier shown in FIG. 3 with two cups therein and being grasped and carried by a user.

The carrier 10 may also be used to dispense and temporarily store the beverages during consumption, allowing the user to repeatedly remove and reposition the container 15 in the aperture 14 when in the folded position wherein the container can be inserted back into the secured position as shown. As each side edge of the device 10 is open in this example, a user can simply reach in through the side and grasp the container for drinking and then replace the drink as needed. A three hole carrier 20 is shown in FIG. 3, which similarly would allow one to three drinks to be easily carried due to the self-stabilizing nature of the carrier 20. As shown in FIG. 3, upon being lifted, the carrier 20 effectively self-adjusts to the load provided by the filled beverage container 15 to provide stability. As seen in FIG. 3A, which shows two cups carried in the three hole example 20, this self-adjustment also holds true if less than the maximum number of cups 15 are positioned in the carrier 20. In this example, the extra width of carrier 20 and inward sloping sides expose the outer holes for easy insertion of a cup therein, either initially for carrying or for repeated use when consuming the drink. This may allow a user to load food products into a portion of carrier 20 first, and then add a drink for example. In an environment such as a quick service restaurant where drinks are dispensed on a self-serve basis, this would allow easy handling of the food and drinks by a user for example. The easy access to the storage area of the carrier in the foregoing and other examples of the invention, also encourages use, and provides an easy and yet effective carrying device which leaves the fingers and other hand of the user free, such that the user can avoid carrying cups in their hands, thereby eliminating any difficulty or struggle with doors, etc. In the example of FIG. 3, it is also contemplated that the center hole may be optional if desired, providing a space for positioning and carrying food or other items.

Figure 3B:
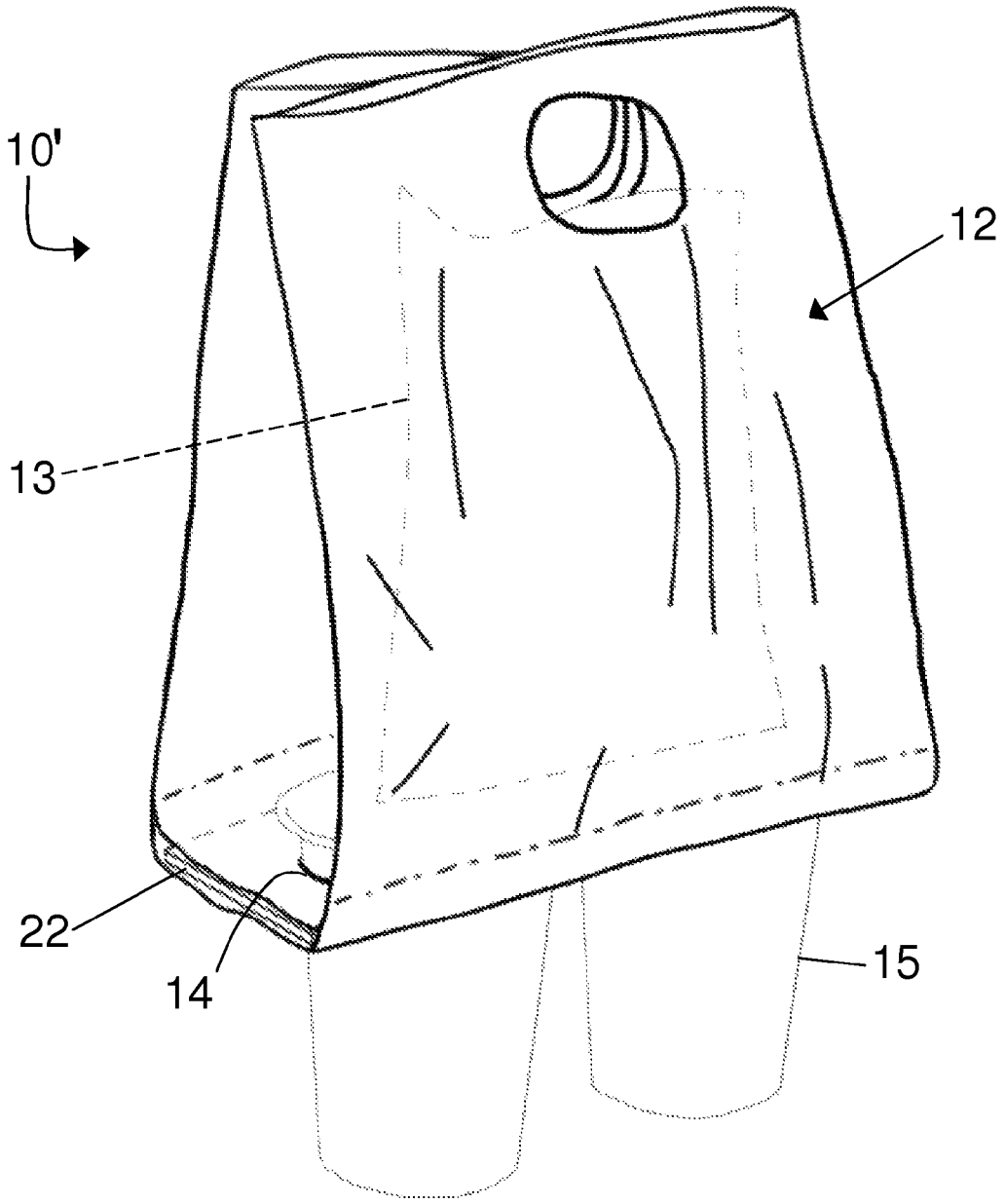
FIGS. 3B-3D show additional examples of carriers according to the invention.

In FIG. 3B, the carrier 10' may have a more rigid or robust material sheet 22 inserted between layers in the area of cup openings 14, which could be a paperboard or plastic material for example. The sheet 22 could be heat sealed inside, adhered, or otherwise attached in the carrier 10' if desired. The sheet material 22 would be formed with holes corresponding to holes 14 in the carrier 10'. Such a sheet material 22 could facilitate preventing stretching of a thin film plastic material used to form carrier 10' and/or assist in supporting cups 15 in carrier 10', and prevent cups 15 from falling through the holes 15. This may allow for use of a thinner, less robust material in forming the carrier 10' while still providing support for the cups 15 for example. As the sheet material 22 is only provided at the location of openings 14, the rest of the carrier 10' is still flexible to allow self-stabilizing as described above.

Figure 3C:
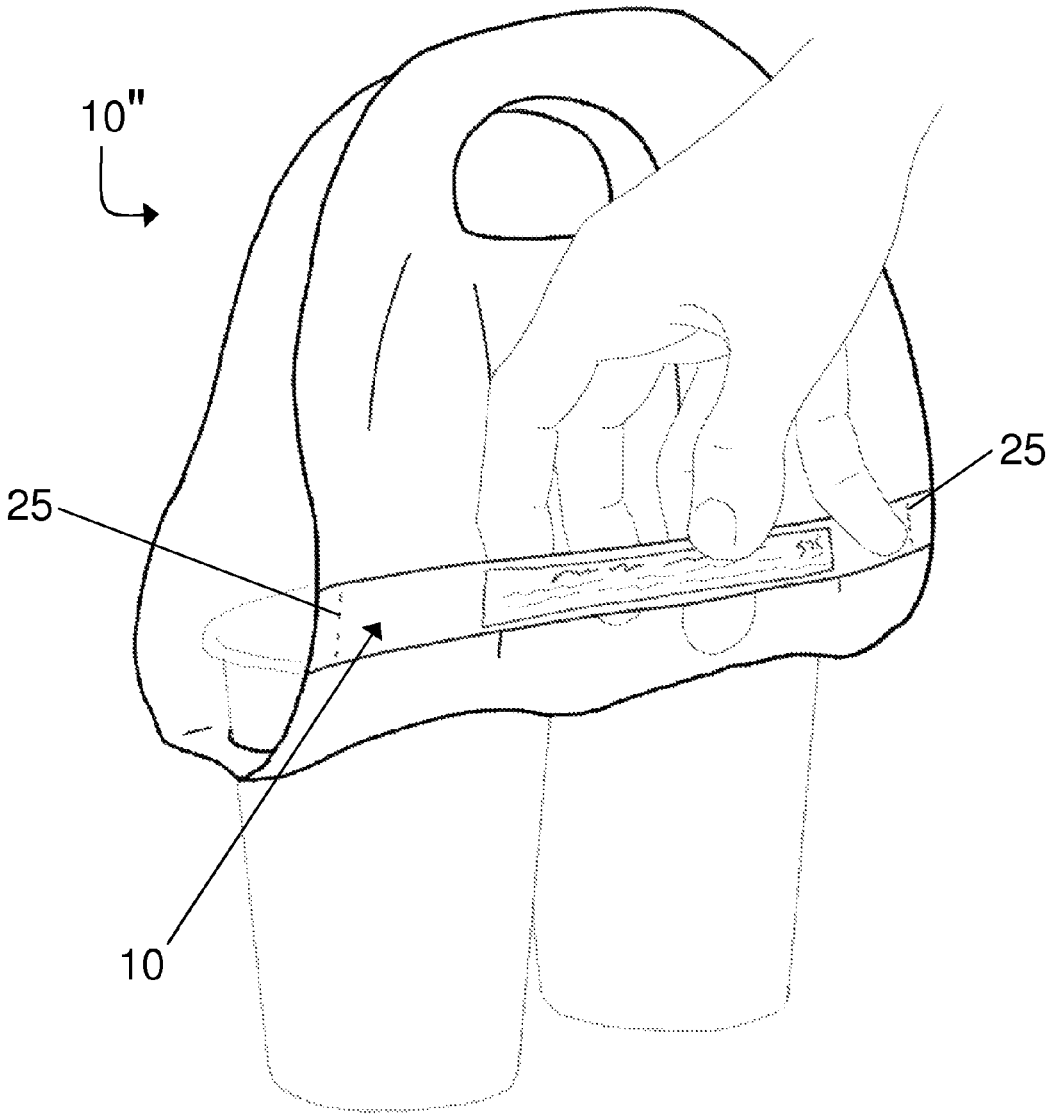

An alternative shown in FIG. 3C may include a thin strip 24 of plastic which is heat sealed or otherwise provided on one or both sides of the outside of the carrier 10", whether formed with no pockets or with pockets. Such a strip 24 could also be a plastic-coated paper that is heat-sealable to the carrier 10", or a paper or other material that is adhered with glue or other suitable means. In an example, the strip 24 could be heat sealed when the edges or carrier 10" are cut and sealed with heat. On a carrier including pockets, the heat seal attaching the strip 24 could also serve as the seal holding the two sheets together and forming a portion of the pockets. The strip 24 can have perforations 25 to allow for easy removal, could have indicia, such as a bar code or other unique ID provided thereon, to serve as a raffle ticket, token or other promotional item like a coupon or the like, and/or serve as advertising. The strip 24 may have any desired dimensions, and could be heat sealed (or otherwise) at the bottom edge of strip 24, to form a further pocket to place tickets, receipts, promotional items, cutlery, straws, napkins, etc. in. Alternatively to a strip 24, a tube could be used instead, which could contain a giveaway, food, drink or other consumable in solid or liquid form, or other item. The strip 24 or the like can be used as a coupon, raffle ticket or other promotional item, or serve to provide other uses. Alternately, this strip could be taller and/or sealed along its bottom edge, creating a small pocket which could contain raffle tickets, coupons, or other advertisements and be used to store ticket stubs, small merchandise, and the like.

Figure 3D:
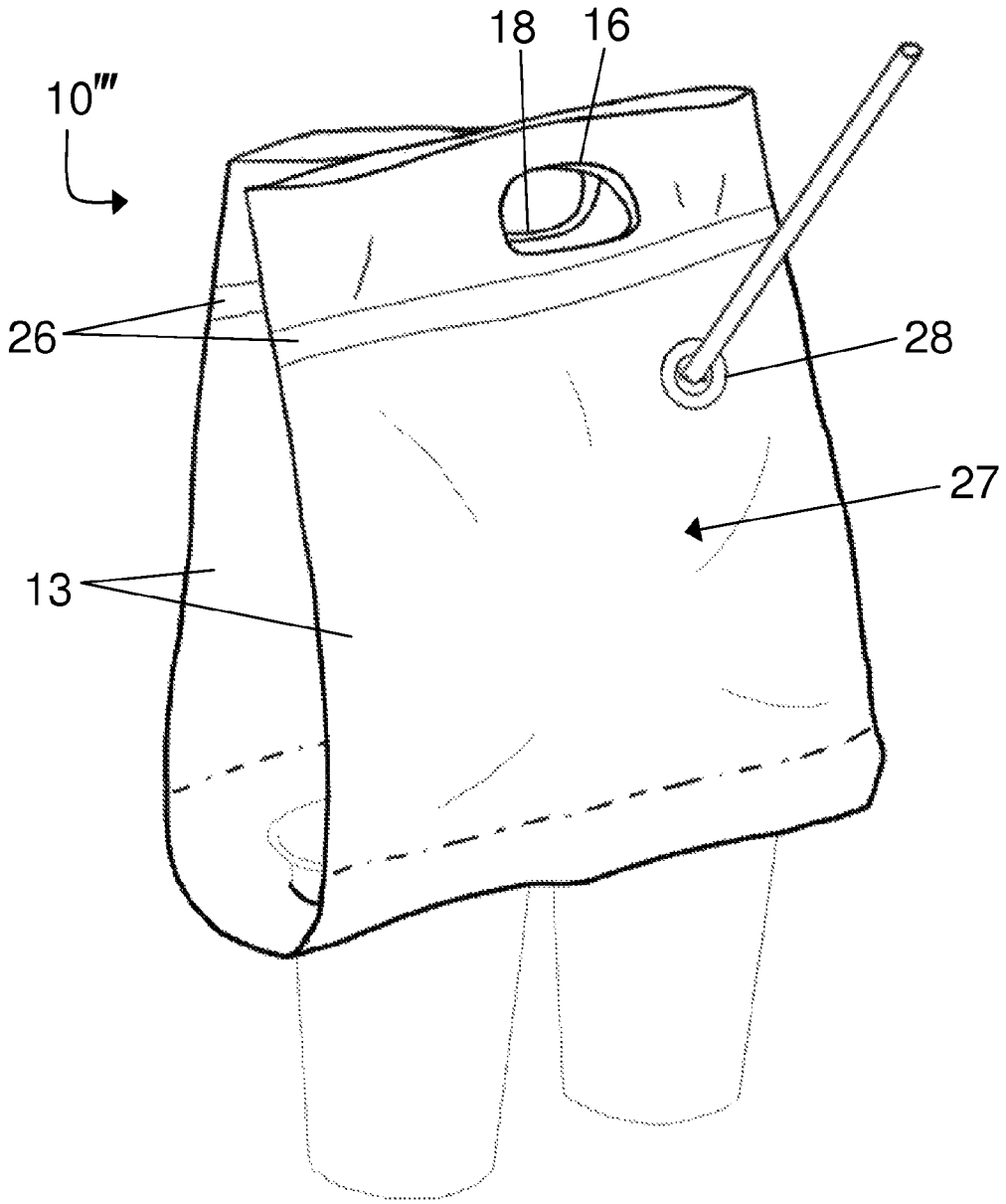

In FIG. 3D, In a further example, the carrier 10'" with pockets or saddle-bags 13 may also have a mechanism to selectively seal or close the pockets 13, such as a closure 26 located near one or both handles 16 and 18, such as above, below, or through the handle portions. The closure 26 would allow selective closing of the pocket 13, or may be an initial seal that encloses materials in the pocket 13, that may or may not be resealable. As an example, an adhesive seal 26 located on inner side of one or both layers of the pocket 13 may be provided. Such a closure may have a peel off layer of film to expose the adhesive on one or both layers, and the user can press the adhesive against other layer to seal the pocket compartment. Alternatively, a zipper type seal comprised of a two part extrusion may be used, with one part on the inner side of each layer of the pocket 13. Such a closure allows the user to press the layers against each other to seal the compartment and pull the zipper seal apart to open the compartment. Alternatively, a hook and loop fastener could be used. Any other suitable closure system, whether permanent or resealable, is contemplated and may be used. The ability to provide a closed pocket system may also allow the pre-packaging of food or other products in the pocket(s) 13, may allow pre-packaged snacks or meals to be provided in a carrier 10 for later consumption. In such an example, the pocket(s) 13 may be sealed by a suitable approach, such as heat, ultrasonic or the like sealing, with products in the compartment. For some products, it may be desirable to have the products vacuum sealed in the pocket(s) 13. Such an example may allow food, medicine or other products to be distributed via suitable outlets, such as the grocery or convenience store, pharmacy or institutions such as hospitals, the military or the like for indoor or outdoor use. The carrier 10, or pocket(s) 13, may also be formed of a suitable material to allow pre-packaged food or other products to be heated in microwave, boiling water or the like. The ability to store products in the pocket(s) 13 may also allow food or other products to be provided in carriers 10 in a manner to be queued up behind a dispensing counter for example. A further example as shown with respect to FIG. 3D is provided wherein a beverage is pre-packaged in a pouch 27 formed from or in the pocket(s) 13. In such an example, the pocket 13 could also carry a pre-sealed beverage pouch in a portion of it, with the beverage accessible through a port 28. The port 28 may be similar to beverage pouch type products, with the port 28 providing the user the ability to punch a hole in carrier or pouch using a straw or the like. In such an example, the carrier could include a pre-made part for allowing access to the beverage pouch, or the outer layer of carrier adjacent the pouch could be made pierceable at port 28, and a more rigid target ring could be provided adjacent the port 28 if desired. Also in such an example, the carrier 10'" may be formed to not have drink/cup carrier holes if desired, as a beverage is pre-packaged in the carrier.

Figure 4:
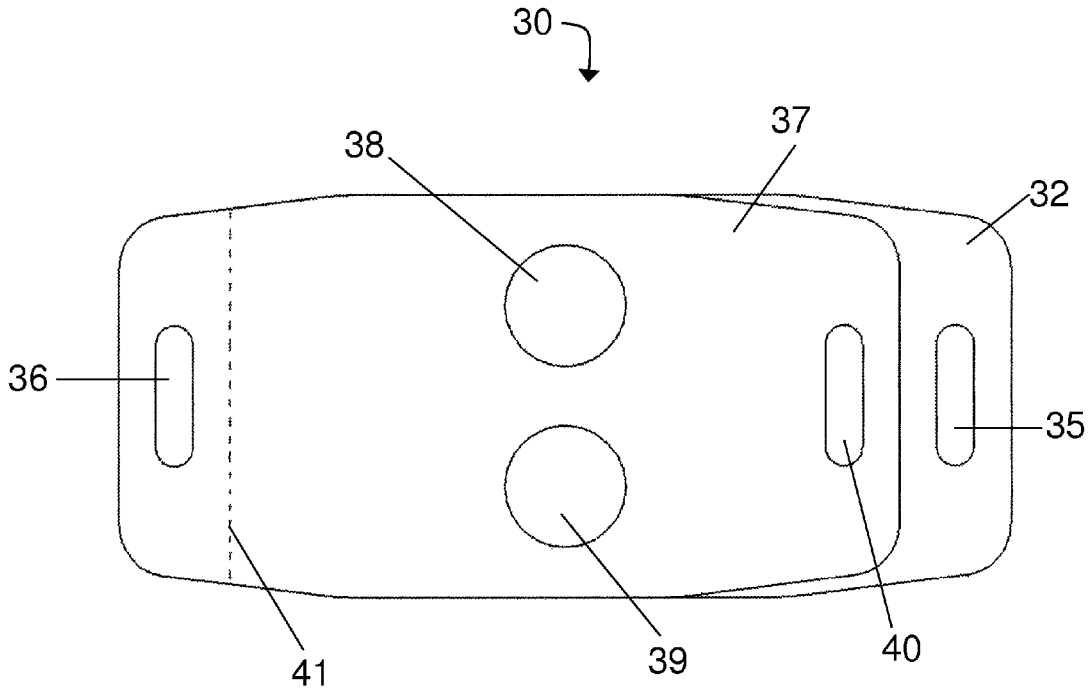
FIG. 4 is a top plan view of another example of a carrier according to the invention, showing the carrier in an unfolded state.
Figure 5:
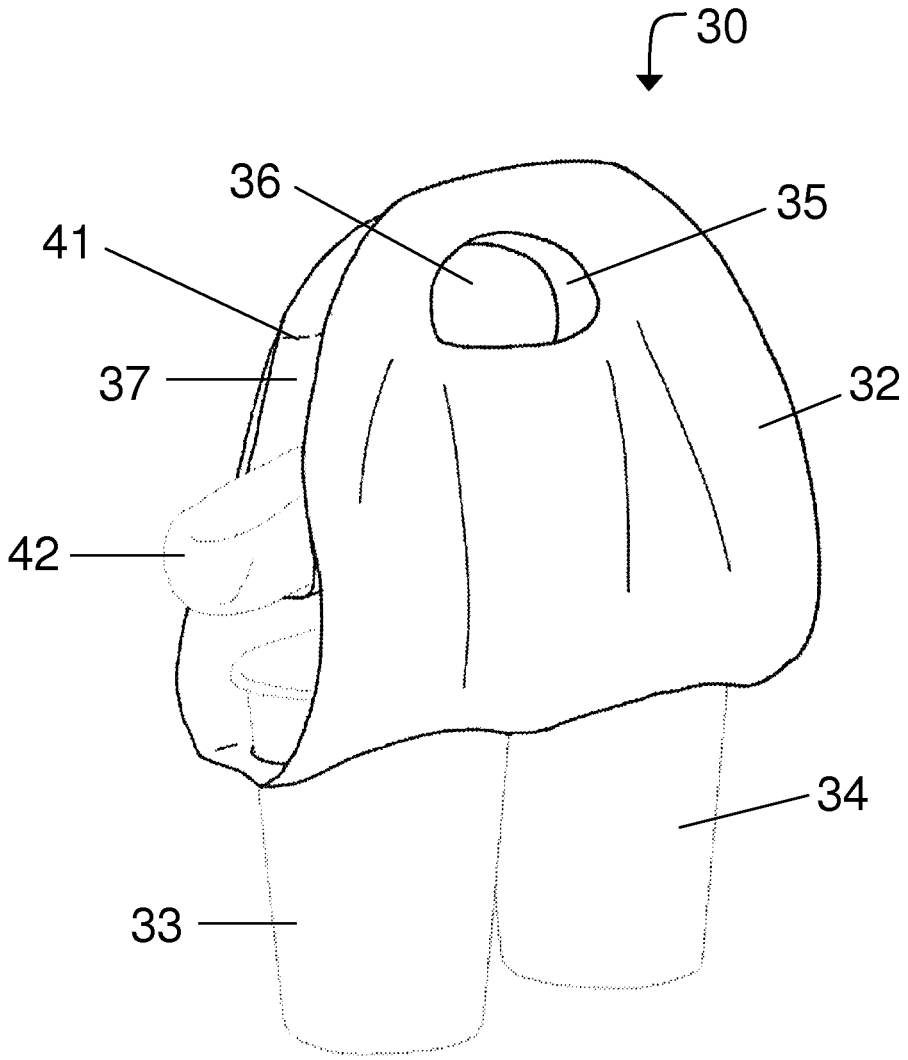
FIG. 5 is a perspective view of the carrier shown in FIG. 4, in use carrying beverages and food items as an example.

In another example of the invention as seen in FIGS. 4 and 5, carrier 30 includes a first base sheet 32 of at least one layer of a polymeric material having an arrangement of at least one aperture formed therein. In the example shown, two apertures 38 and 39 are provided in the base sheet 32 for receiving multiple beverage containers 33 and 34, but further apertures may be provided if desired. A plurality of handle members 35 and 36 are provided for receiving the finger(s)/hand of a person carrying carrier 30. Multiple layers, including two or three layers of polymeric material, are also considered for base sheet 32 of carrier 30 if desired. Similar to the prior example, sheet 32 may be constructed of a flat, durable, flexible thermoplastic polymer, such as MDPE. In this example, carrier 30 also includes a second sheet 37 of at least one layer of a polymeric material, also having an arrangement of apertures corresponding to the number of apertures 38 and 39 in the base sheet 32, and a handle member 40. Second sheet 37 is heat sealed along heat seal line 41 to first sheet 32 such that it is fixed in position with the base sheet 32 on one side. The second sheet 37 is of a shorter dimension, such that in use, it forms a sling intermediate the handles 35 and 36 and holes 38 and 39 of the base sheet 32. In use for carrying both beverages and other items for example, the sheet 37 may be folded over to expose the holes 38 and 39 in the sheet 32, allowing beverages to be positioned therein. The sling may then be used for carrying food items in addition to drinks positioned in the holes 38 and 39 as shown in FIG. 4. The second sheet 37 may also be provided with holes if desired, which are formed in the second sheet 37 in alignment with apertures 38 and 39 of base sheet 32. In this example of the invention, if apertures are provided in the second sheet 37 which are in alignment with apertures 38 and 39 of base sheet 32, beverage containers 33 and 34 can first be inserted into and through apertures formed in the second sheet 37, and then into and through the aligned apertures 38 and 39 of first sheet 32 if no food product 42 is positioned in the sling portion of the carrier 30. If no food items are to be carried, the provision of holes in both the second sheet 37 as well as first sheet 32 allow for quick loading of the carrier 30 in a manner similar to the prior examples.

FIG. 5 illustrates container carrier 30 in a functional position. In use, carrier 30 is temporarily secured in a folded state when at least one finger of a person's hand is inserted through handle members 35, 36 and 40. In the folded state, carrier 30 includes a beverage carrying portion formed from first sheet 32 and a food carrying portion formed from second sheet 37. Once carrier 30 is in the functional position, a person can carry carrier 30, which includes beverage containers 33 and 34 and a food product 42, such as submarine sandwiches, hamburgers, hot dogs or the like, or any other items or products, to a desired destination. Carrier 30 prevents beverage containers 33 and 34 from tilting over and spilling the beverage from the containers and allows food product 42 to be conveniently stored and carried with carrier 30 while in its folded state, using only one hand.

Figure 6:
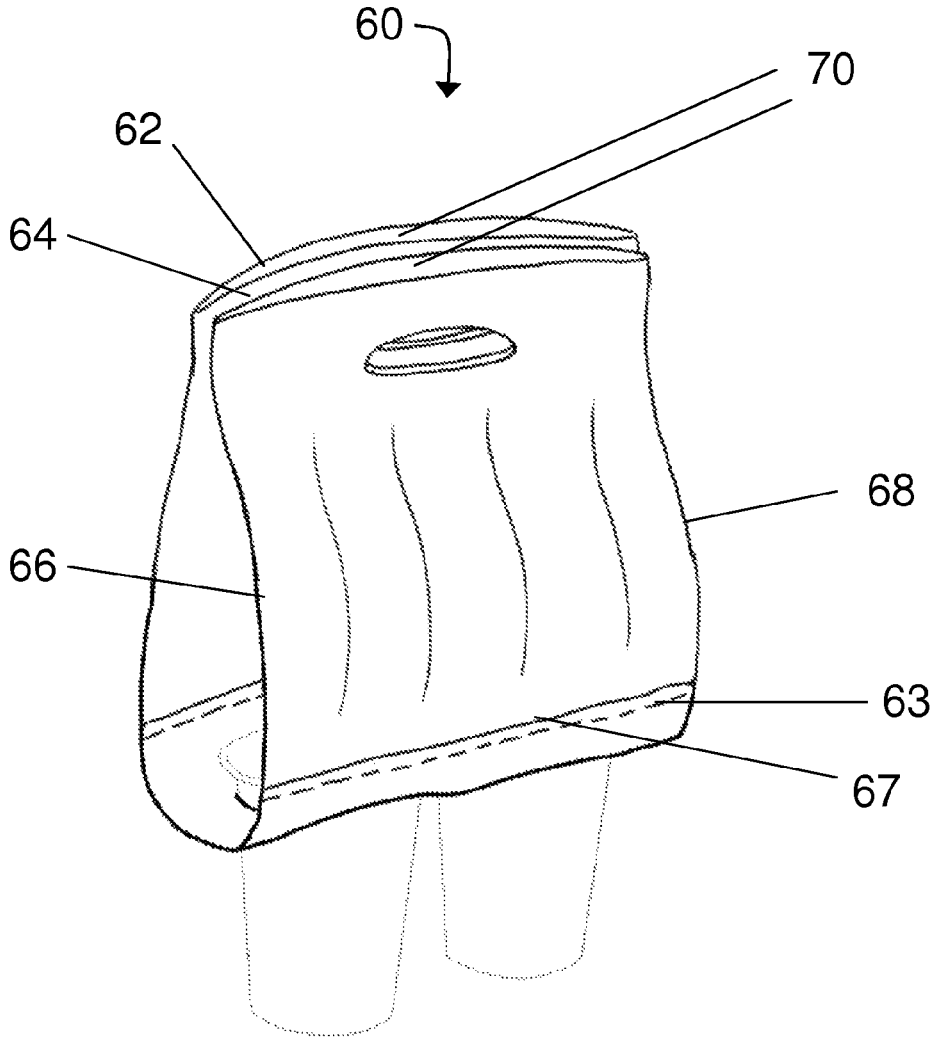
FIG. 6 is a perspective view of a further example of a carrier according to the invention, showing the carrier in a folded state.
Figure 6A:
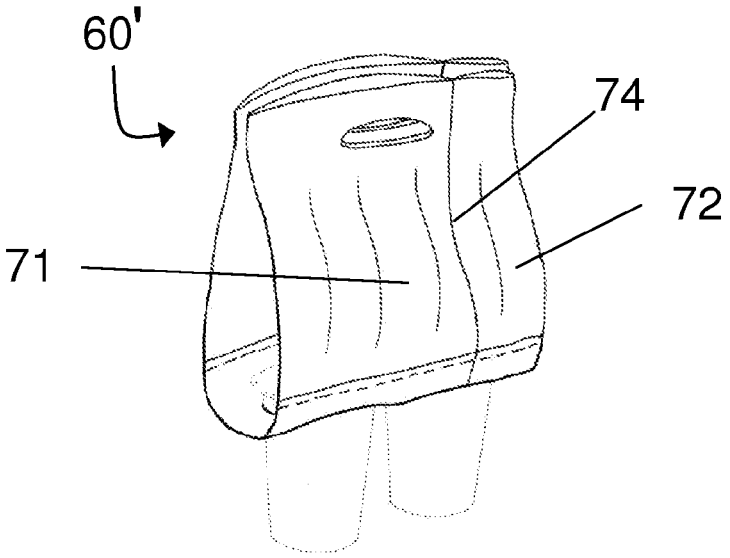
FIGS. 6A through 6H are perspective and sectional views of alternative examples of the carrier according to the invention.
Figure 6B:
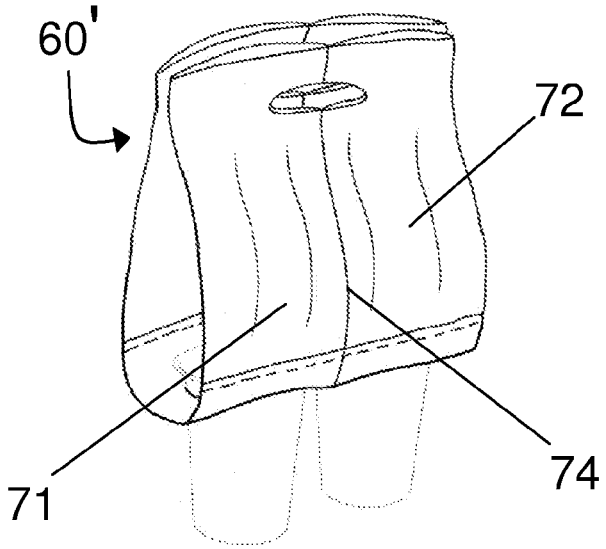
Figure 6C:
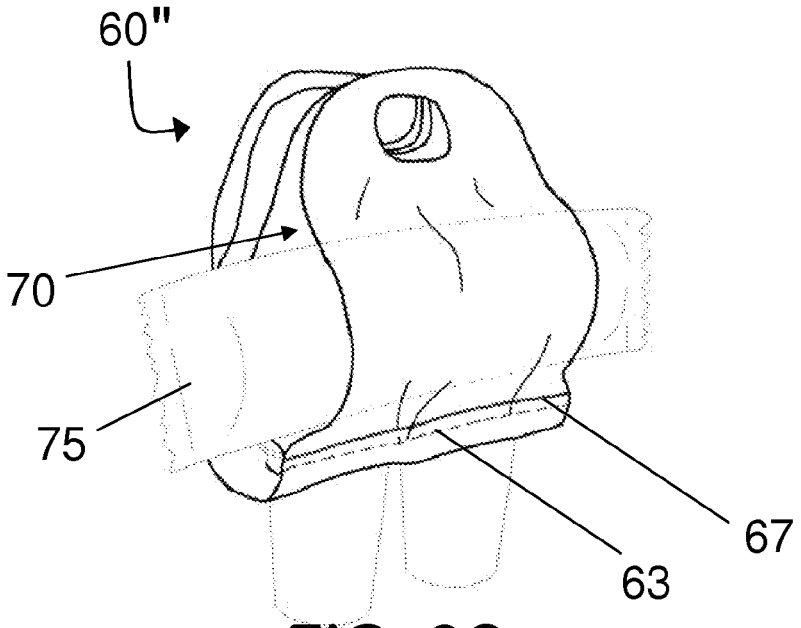
Figure 6D:
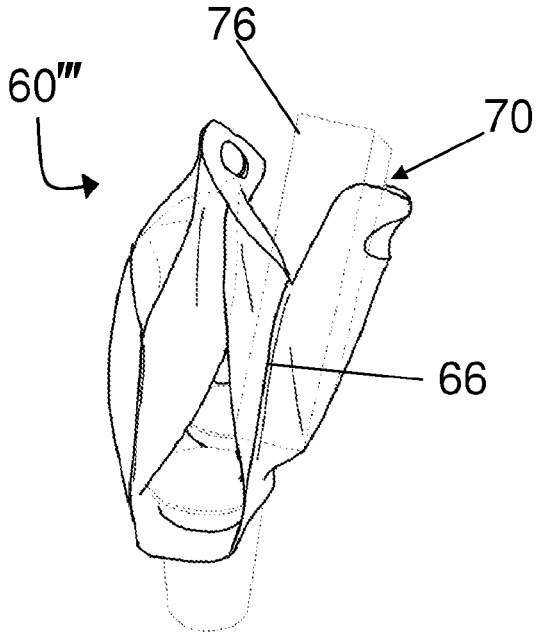

A further example of the carrier according to the invention is shown in FIG. 6. In this example, the carrier 60' is formed of at least two plastic film sheets 62 and 64, which may be substantially identical. The sheets 62 and 64 may be secured to one another by heat sealing or the like, at positions at least partially up the sides 66 and 68, and along a lower end 67 of one or both sides of carrier 60', to thereby create one or more pockets 70, for the storage and carrying of food products or any other items. As seen in FIG. 6, the pocket 70 may be formed as a single large pocket that would accommodate a variety of items for example. If desired, a perforation cut 63 can be made below the heat seal that forms the bottom of the single pocket, or multiple pockets, allowing a single or multiple cavity pocketed side to be removed by the user by tearing the perforation, from the remainder of the carrier. Thus, after beverages or food or both have been transported, or at another convenient time for the user the pocketed sides can be separated and used as a bag type device, independently from the rest of the carrier. This tear-away feature enables the users to independently serve another person, carry and dispense food or other merchandise in the one or both pocketed sides after separation from one or both adjacent edges of the centrally located drink apertures. The separated pocket or bag can be laid on a users lap or tabletop surface, and the food inside can be placed on the flattened side of the bag acting as a convenient placemat-like eating surface while sitting or standing. Further, food or merchandise can be kept clean and carried from the entertainment or other venue by this convenient separable bag or pocket. The perforation will have sufficient strength for carrying the largest and heaviest drinks in the center section, yet be easy enough to, when desired by the user conveniently separate the carrier into two bags or pockets, by tearing the perforation. Alternatively, as seen in FIGS. 6A and 6B, the at least one pocket 70 may include several pockets 71 and 72, in one or both sides of carrier 60'. As seen in FIGS. 6A and 6B, the pockets 71 and 72 are formed by an additional heat seal 74 which divides the pocket 70 into multiple pockets. In FIG. 6A, the pockets 71 and 72 are of different proportions, wherein FIG. 6B shows pockets 71 and 72 with similar proportions. Any proportions or number of pockets can be formed in association with carrier 60' accordingly. In the example of FIG. 6A, the pocket 72 may be formed to more particularly accommodate a food item such as a hot dog, lottery ticket, coupon, advertisement flyer or the like, while pocket 71 could be used for other items. The material from which the sheet 62 is made may be of a clear or translucent material to allow items positioned within a pocket 70 to be visible if desired. The one or more pockets 70 may be formed to accommodate particular items if desired. In other examples, the one or more pockets 70 may be formed with other characteristics, such as for accommodating other items or providing additional functionality. As seen in FIG. 6C for example, the pocket 70 may be formed with only a bottom seal 67, to create open sides into which longer articles 75, such as a submarine sandwich, burrito, book, magazine, newspaper or the like, may be inserted and carried. In the example of FIG. 6D, the at least one pocket 70 may be formed to have side seals 66 and 68 which extend higher (when the carrier 60" is in the carrying position), to allow taller articles 76 to be accommodated more securely. An optional perforation 63 can be utilized to separate the two halves of the carrier to make the two pockets independent from one another if desirable by the end user. For instance, if after the food is consumed, that food carrier section could be detached and thrown away, leaving the pocket carrying the books or magazine to carry goods out of a store or establishment. It should be recognized that the form of the at least one pocket 70 can vary greatly depending on the particular needs of users in different environments and to accommodate different types of items. The side seals 66 and 68 (if used), can vary based on what is to be carried, while the seal at bottom of at least one pocket 70 keeps any contents from interfering with the one or more cups that may be carried by the carrier 60' or the lids of any cups positioned therein. The at least one pocket 70 with heat seal 67 also segregates the drinks from items placed in the pocket(s) 70, and enhances the ability to use the carrier for dispensing the items such as during consumption, allowing repeated insertion and removal of the drinks and/or items placed in the pocket(s) 70.

Figure 6E:
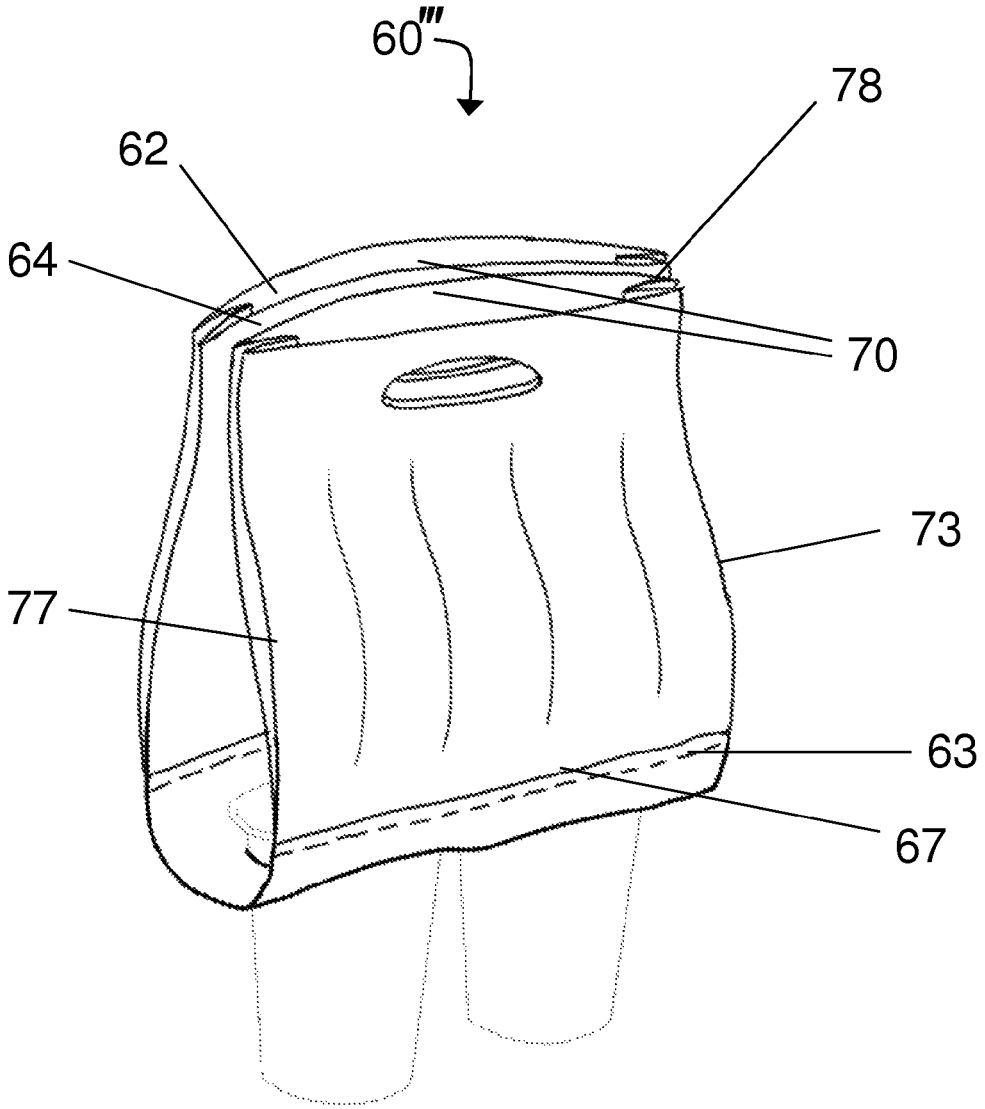
Figures 6F, 6G:
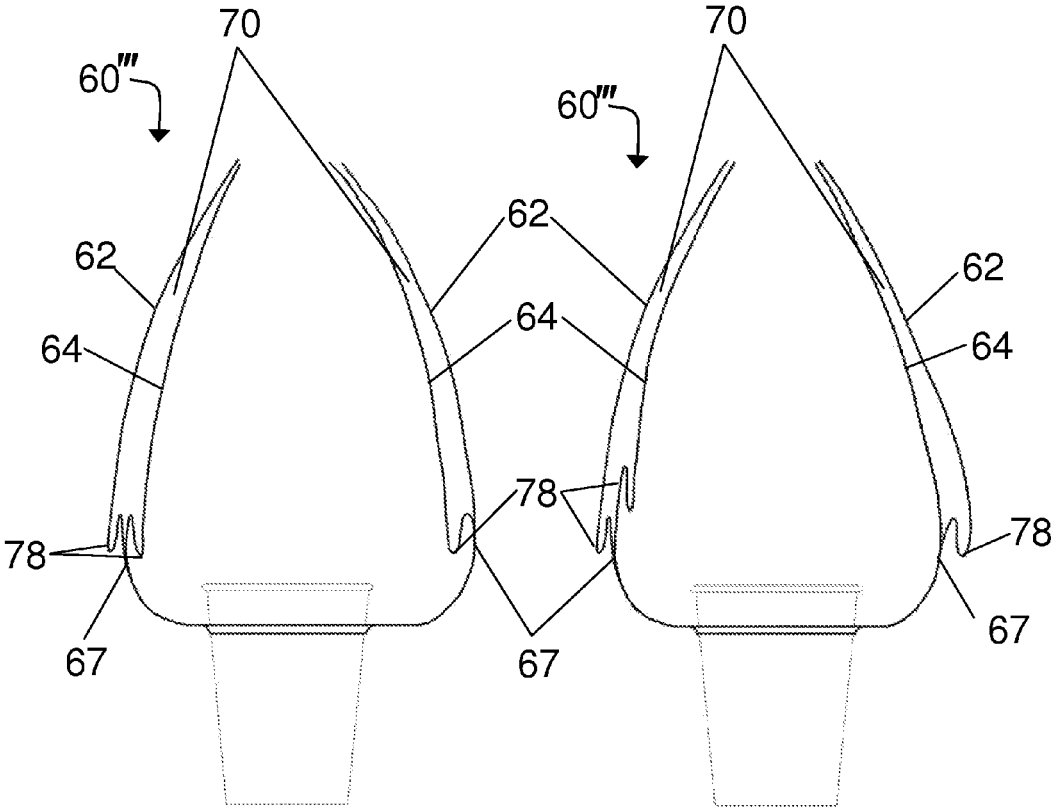

As seen in FIGS. 6E-6G, the carrier 60'" may include folded material resulting in pleats or gussets 78 can be offered as an alternative design which offers greater volumetric capacity of the expandable carrier pockets. Heat seal 67 forms the lower portion of the pocket, while folded material resulting in one or more pleats form sides 77 and 73 of the pockets 70. Perforations 63 allows the user to separate the pockets from one another at a suitable time during use, such as after drinks and food has been carried to their seat at a sporting or entertainment event, or the like. The cutaway views in FIGS. 6F and 6G show that, as an alternative, the pleat or gusset can be located at the bottom of one or both of the carrier pockets. This gusset 78 can be located on the outside or inside of the outermost sheet of material, the outside or inside of the innermost sheet of material, or both. This design allows expansion primarily in the lower portion of the pocket, while keeping the opening at the top small to help keep contents from spilling. If located on both the outermost and innermost sheet, the gussets 78 can either be at the same level, as is shown in FIG. 6F, or offset to reduce the stacking of layers when flat, as is shown in FIG. 6G.

Figure 6H:
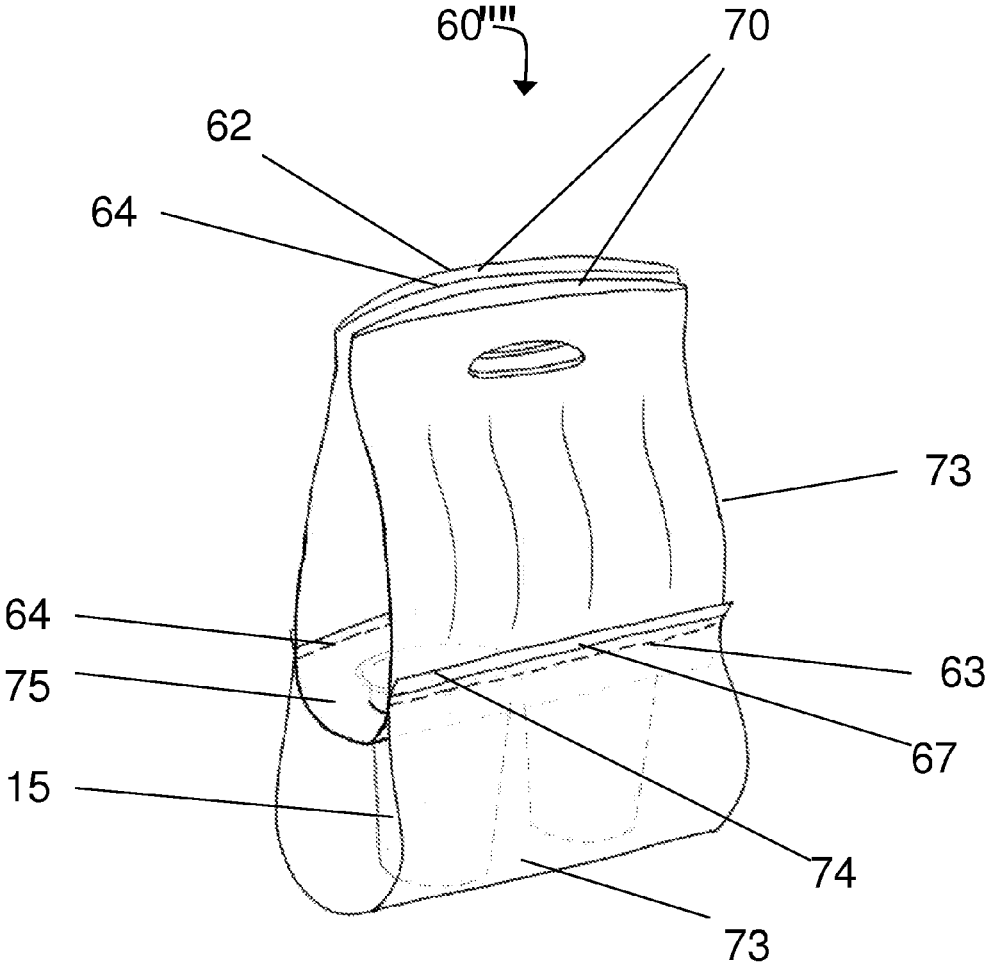

In the FIG. 6H, as an alternative, the carrier 60"" may include one or more layers of material comprise a sling 79 which supports cups 15 beneath. Sling 79 is comprised of one or more layers of material attached via heat seal or the like 67 adjoining to the other material layers comprising the remainder of the food and beverage carrier. The sling 79 and cup holding section 75 can be separated from the pockets via tearing one or both perforations 63 and 64 after drinks have been transported to their desired destination or the like. By tearing the one or both perforations 63 and 64 the adjoined bags are separated into individual bags facilitating dispensing to another person, placing on one's lap or the like.

Further in many environments and applications, the at least one pocket 70 may also be used as a temporary trash receptacle, such as at a stadium event or the like. For example, at a sporting event, a user may purchase drinks and food items as which are easily carried back to their seat for consumption, and any trash produced can be put back into the at least one pocket 70, such as peanut shells, food wrappers, etc. Individual pocket(s) could also be formed for other items, such as a name tag, event schedule, promotional coupons, advertisement, or the like. Similarly to prior examples, the carrier 60 may also be formed without the drink hole(s) if desired, while still facilitating the utilitarian uses for the carrier 60 in carrying a wide variety of items.

Figure 7:
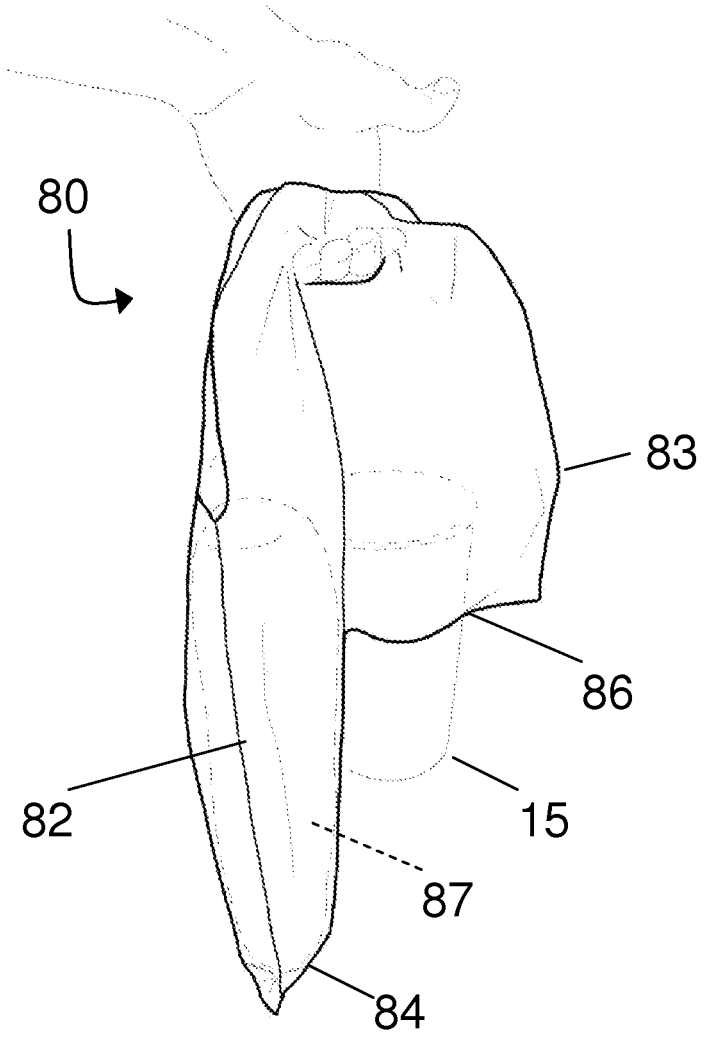
FIG. 7 is a perspective view of a further example of a carrier according to the invention, showing the carrier in a folded state.

In another example as shown in FIG. 7, the carrier 80 is formed for use by an individual to carry a drink and food items for their subsequent consumption. In this example, the carrier

80 is formed of two sheets, which may be substantially identical, and which are sealed together to make the carrier configuration. In the example shown, the carrier 80 has both the left and right sides 82 and 83, along with the bottom 84, which are sealed, such as by heat sealing or the like. A drink hole 86 may be formed in one side of carrier 80, to receive and support a cup 15 in a manner similar to the prior examples. The remainder of the carrier 80 is then available for food or other items, such as a submarine sandwich 87 as shown. The top portion of each sheet is provided with a handle opening, allowing the user to easily carry the carrier 80 with at least one finger inserted therethrough. If desired, separate compartments or pockets may be formed by a heat seal between the area for insertion of the drink into the hole 86, and the food or other item storage pocket. The carrier may be dimensioned to accommodate any desired food or other items as desired. A slight derivative of this version may be comprised of one or more cylindrical, closed-end compartments with a hand hole which could be used to conveniently and space-efficiently carry bottles of wine or like articles from a grocery or beverage store.

Figure 8:
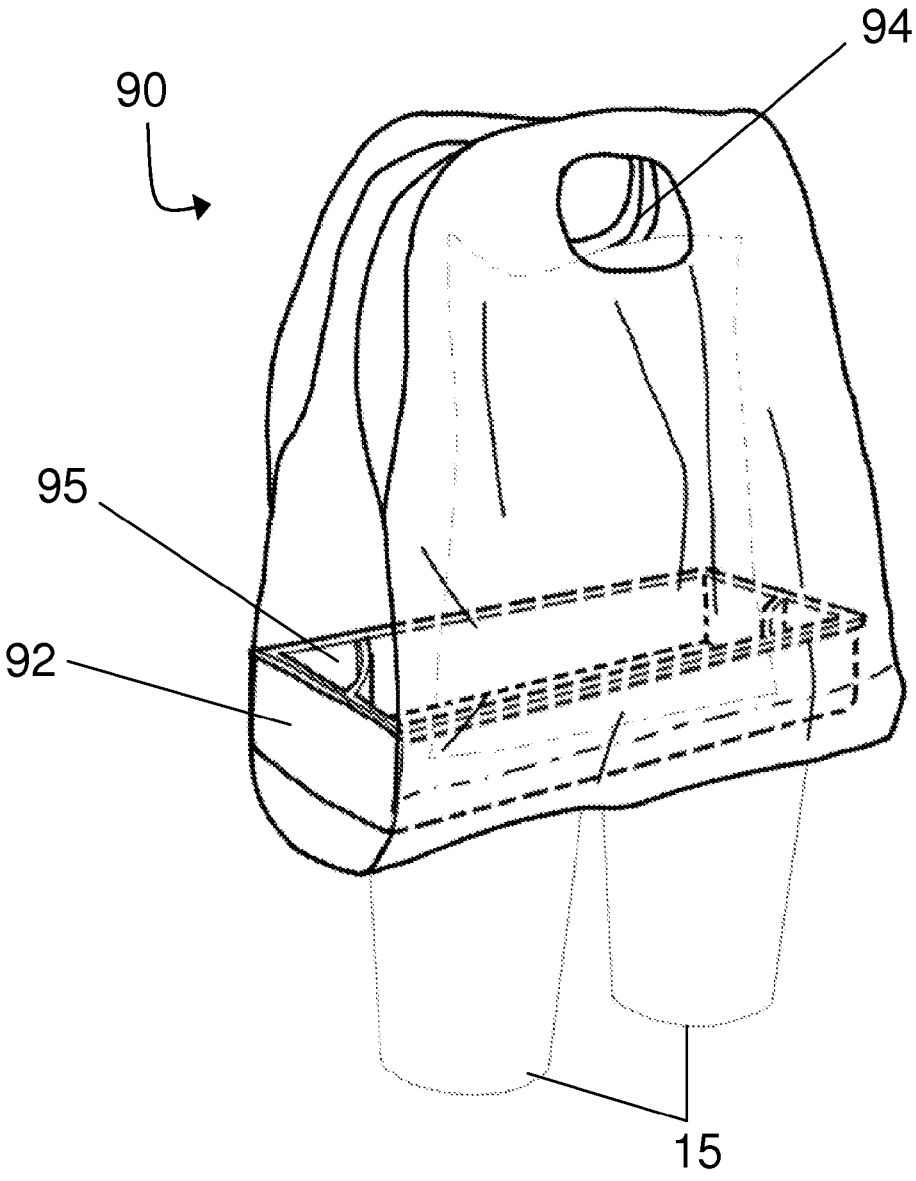
FIG. 8 is a perspective view of a further example of a carrier according to the invention, showing the carrier in a folded state.
Figure 8A:
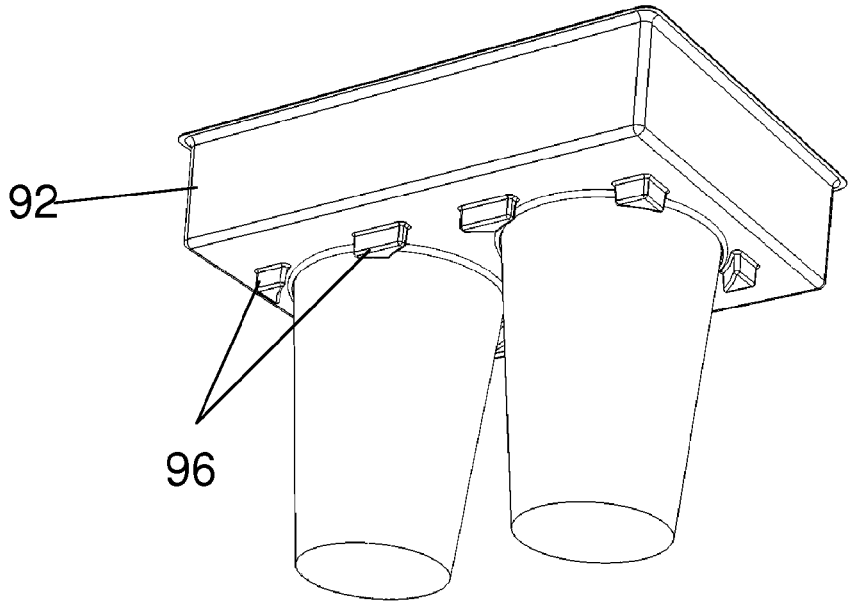
FIGS. 8A through 8D show alternative tray members for use with the carrier as shown in FIG. 8 for example.
Figure 8B:
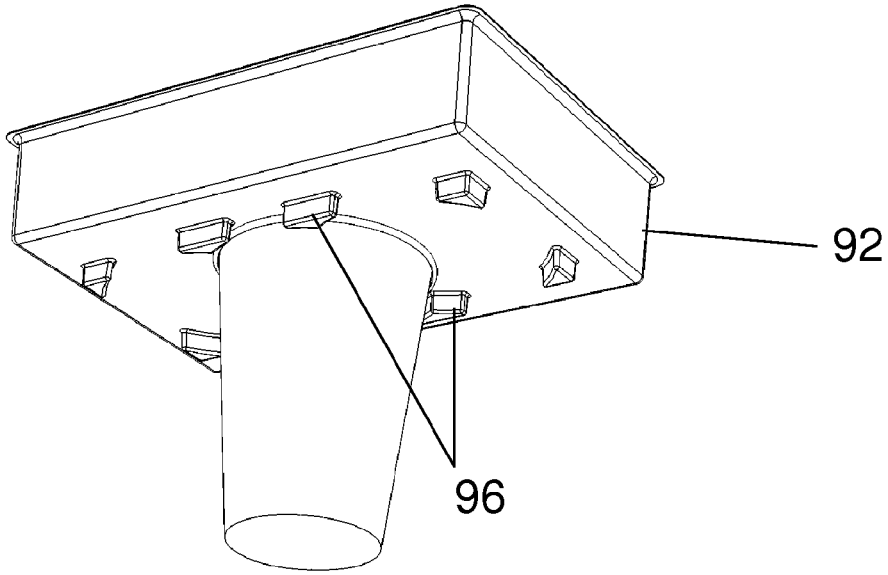
Figure 8C:
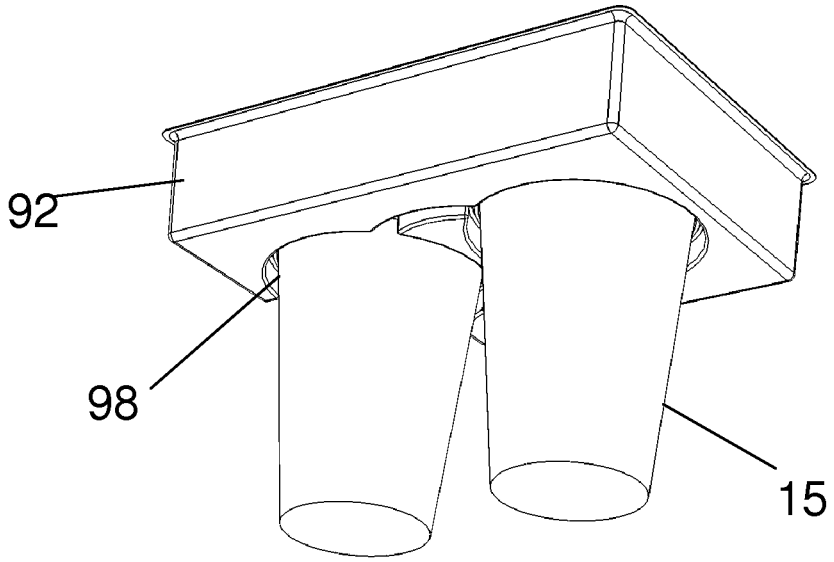
Figure 8D:
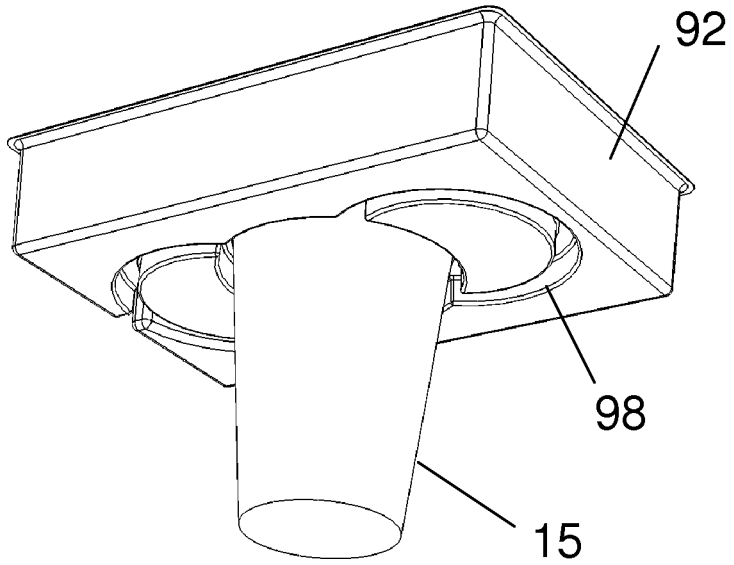

To further facilitate use of a carrier in accordance with the invention with various more particular food or other items, the carrier configuration can be adapted for such particular food or other items. In FIG. 8, an example is shown for use in carrying drinks as well as food items, such a chips or nachos, vegetables and dip, or other items which are popular and offered in many environments. When purchasing nachos for example, typically a plurality of tortilla chips are provided in a tray, and an amount of nacho cheese is provided in a separated compartment formed in the tray or in a separate container. The user must carry the tray in one hand, and if any drinks are purchased, must use their other hand. In this example, a carrier 90 may be similar to the examples shown previously, such as in FIG. 1, 2, 3, 5 or 6. In association with the carrier 90, a tray 92, such as for nachos or any other food or other products, may be provided for use in association with the carrier 90, or for use independently of the carrier. The tray 92 may be a thermoformed tray or formed in any other suitable manner, and be dimensioned and shaped to fit in the space between the cups 15 and handles 94. If desired, the tray 92 may have a compartment 95 formed therein for cheese sauce to be provided. The compartment 95 may be used for other materials like dips or the like, and can be located in the center portion of the carrier (not shown) if desired. To facilitate maintaining the tray 92 in the position as shown in FIG. 8, the tray 92 may be formed to have nubs or bosses 96 on its bottom side as shown in FIG. 8A, which are positioned to engage the tops of the cups 15 if the tray 92 begins to slide, and thereby prevent the tray 92 from sliding out of its position in carrier 90. As cups 15 may have different size tops, the bosses 96 may be positioned to accommodate different sized cups 15, while still preventing any substantial sliding of tray 92. Alternatively to the bosses 96 the tray may have circular type female grooves 98, such as shown in FIG. 8C to engage the tops of cups 15 and prevent sliding of tray 92 relative thereto, or similarly functional circular male rings protruding from the tray bottom surface, that surround the top rim of a cup which prevent sliding of the tray off one or more cups. The depressions 98 and nubs 96 may accommodate any number of cups 15, such as the two cups 15 shown in FIGS. 8A and 8C, or one cup 15 as shown in FIGS. 8B and 8D. This allows the tray to fit the tops of the cups when they are in carrier 90 or be balanced and reasonably secured when on top of one cup held in the user's hand. With reference to these Figs., the tray may have projecting portions (or female portions) from its bottom that may facilitate positioning the upper open ends of cups positioned in the carrier or otherwise, in association with the male or female portions on the bottom of the tray, to maintain to position of the tray therewith. Alternatively, the projecting portions can securely position the tray in the cup openings of the carrier itself if no cups are placed therein. If only one cup is carried in the carrier, the shape of the projecting portions (or female portions) is such that the top of the cup is surrounded at least in part by the projecting portions, again securely positioning the tray with the cup. The tray configuration is thus adaptable to a variety of uses for a particular situation.

Figure 9A:
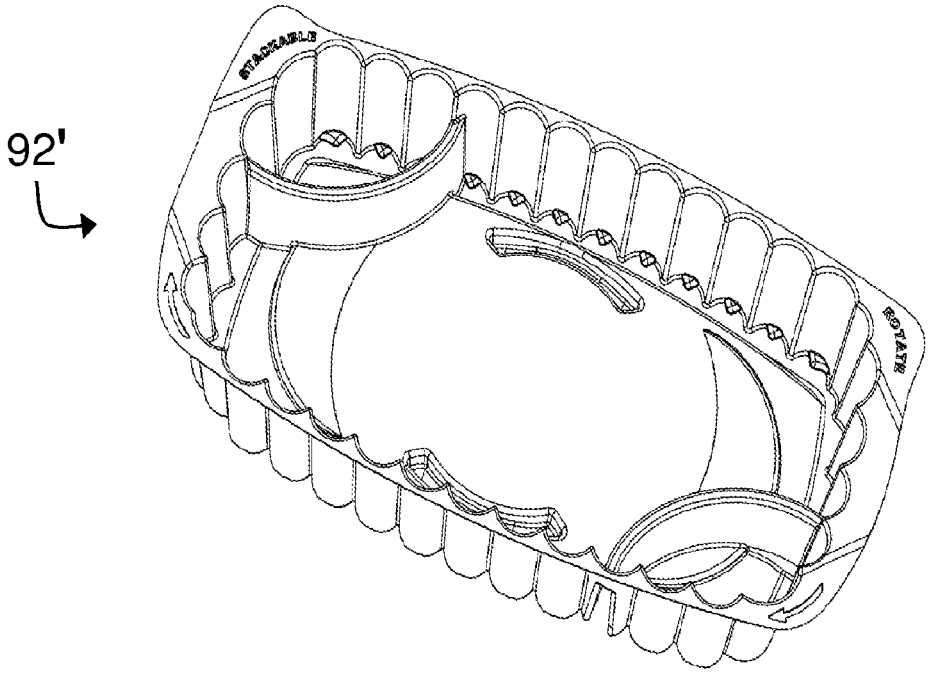
FIGS. 9A-9M show an alternate tray configurations, and schematic illustrations showing features thereof.
Figure 9B:
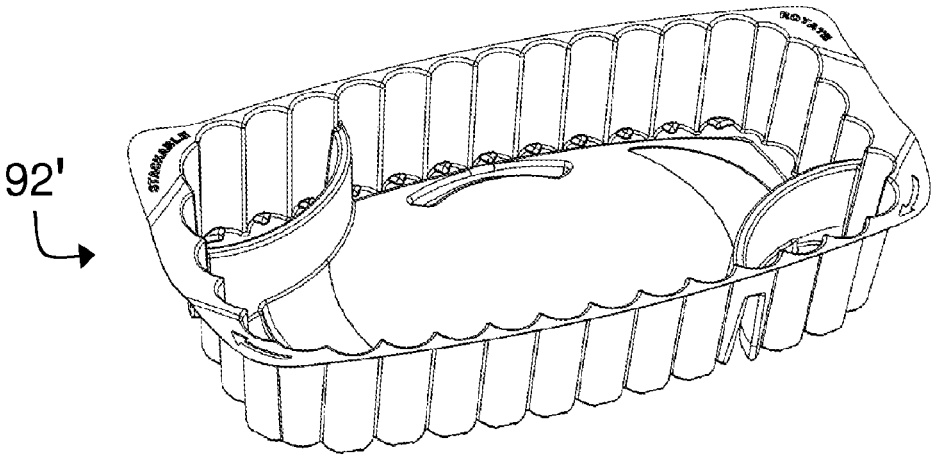
Figure 9C:
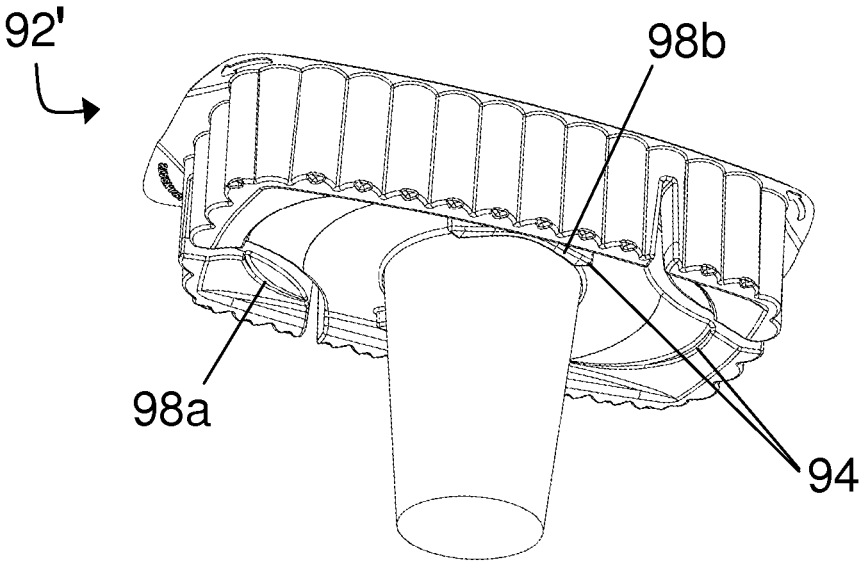
Figure 9D:
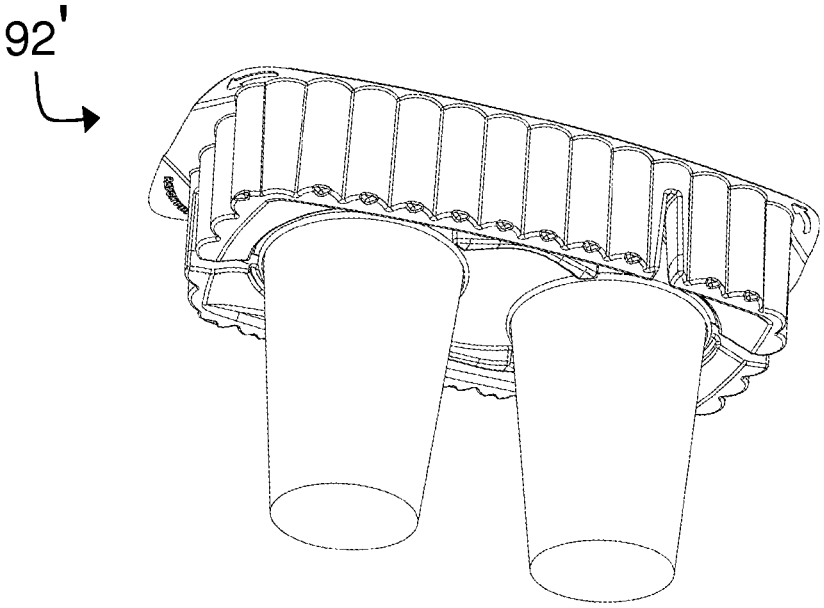
Figure 9E:
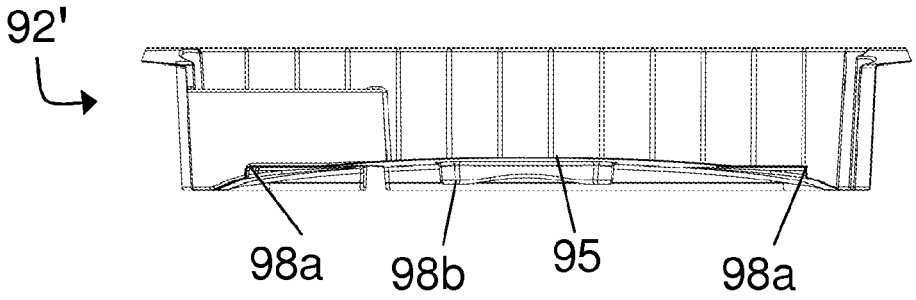
Figure 9F:
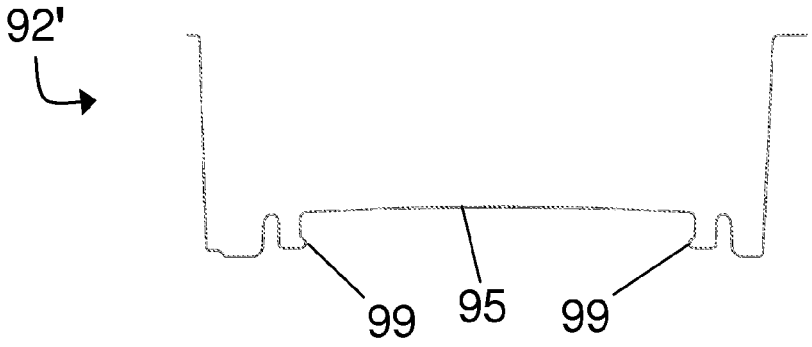
Figure 9G:
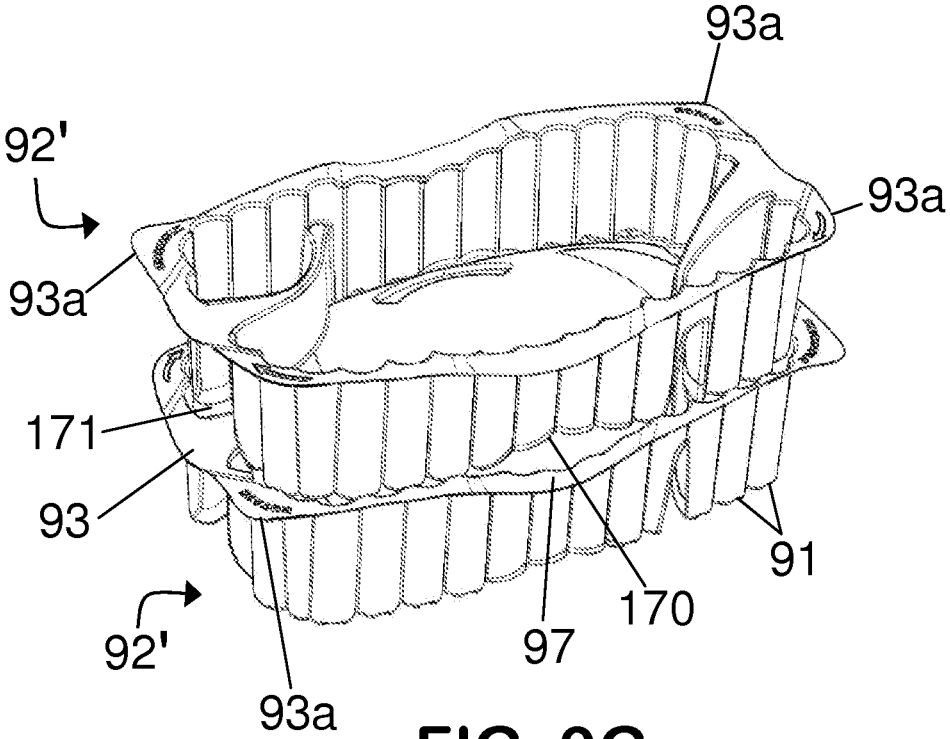
Figure 9H:
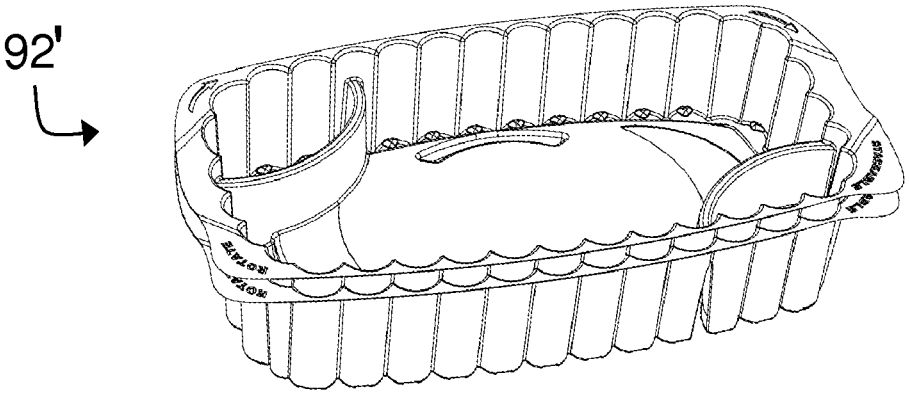

Further examples of a tray are shown in FIGS. 9A-9H, that is ergonomically configured for easier handling by a user. As seen in these examples, the tray 92' may have side walls having a convex (or concave) shape as shown in FIGS. 9A and 9H, that helps a user to grip the tray 92' as well as to facilitate being retained in the carrier due to the material of the carrier gripping the tray 92' once it is positioned in the carrier. The curved (convex or concave) nature additionally provides stiffness and strength to the tray 92' which may be otherwise weaker. The tray 92' may also have a dished platform 93 (FIG. 9G) that creates a spot for the thumb of the user to grip the tray 92'. The tray 92' may also have platforms 97 (FIG. 9G) on one or both long sides of the tray to facilitate grasping and supporting the tray 92'. Clearance for said thumbs used to carry the bottom tray 92' in a stack of trays 92' can be created such as the arcing geometry 170 for use with platform 97 or open area 171 for use with platform 93. On the bottom surface, there again may be male or female type structures 94 to facilitate carrying tray 92' in conjunction with one or more cups 15. As seen in FIGS. 9C-9D in this example, half moon structures 98*a* may be provided to align with the tops of two cups 15 to keep tray from sliding off while being carried in a carrier as in any of the examples of the carrier according to the invention. Alternatively or in addition, middle arcs 98*b* may be provided to grip a single cup. Apart from use with a carrier, such structures also would allow the tray 92' to be carried on top of one or more cup(s) held in the hand(s). The male or female type structures 98*a* or 98*b* could also be provided with structure to attach to the cup 15 in a manner similar to lids provided for cups, such as having an undercut 99 as seen in FIG. 9F, to grip a cup lip associated with the cup. Also in this example as seen in FIGS. 9E and 9F, the bottom surface 95 may be formed to arc upwardly in center to create walls that interact with cups, while the outer perimeter remains to keep surfaces that will touch the cups off of counter/table surfaces to prevent or reduce contamination for example. As should be recognized, the surface of the cup lip touches the bottom surface of tray 92' above the bottom extent of tray 92'. The bottom could also be recessed in a rectilinear manner to achieve offset from bottom for this purpose if desired.

Figure 9I:
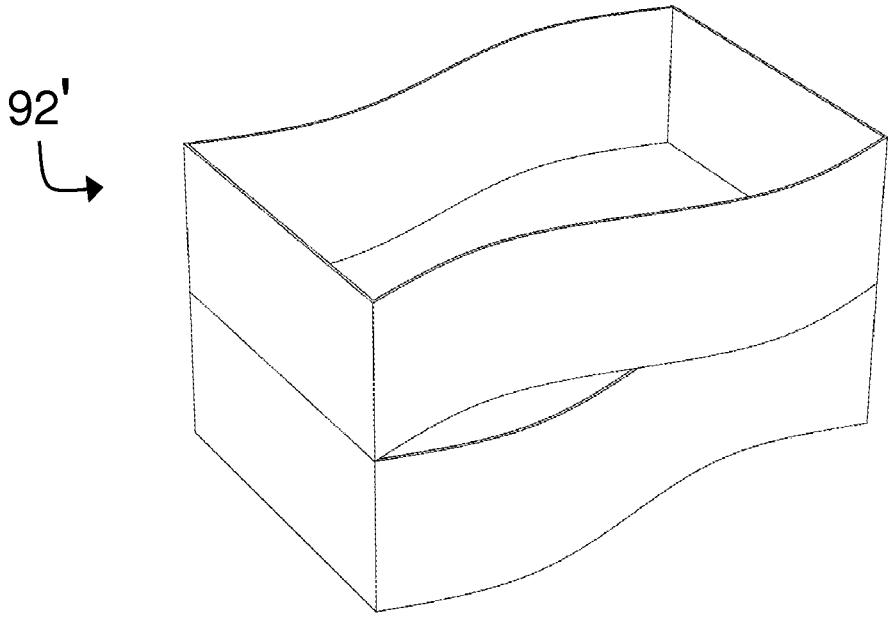
Figure 9J:
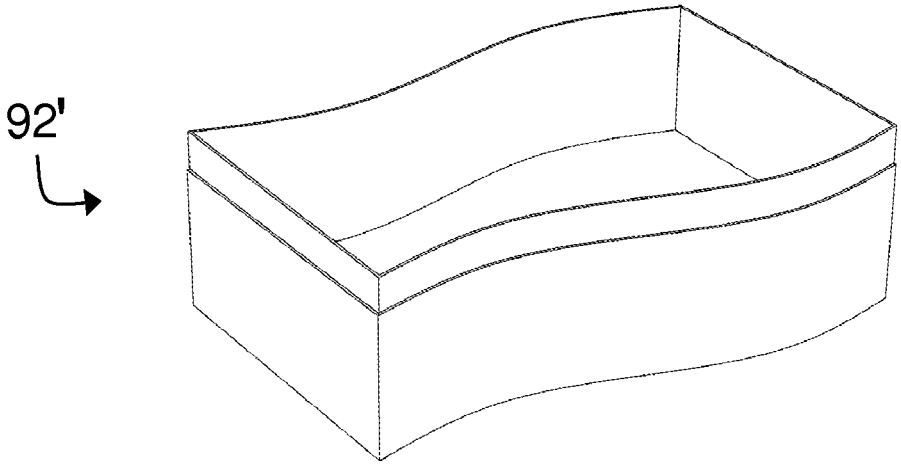
Figure 9K:
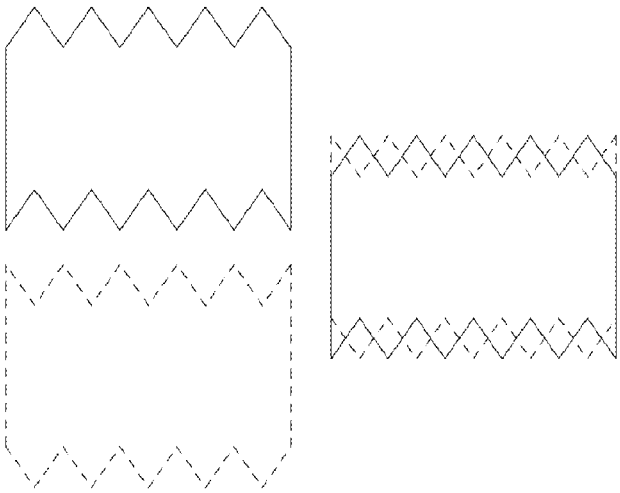
Figure 9L:
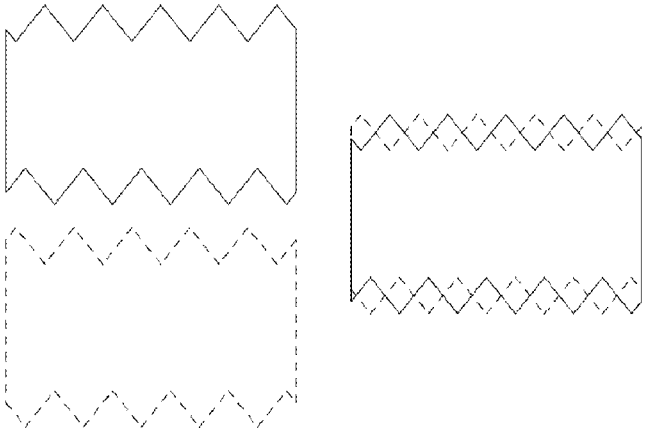
Figure 9M:
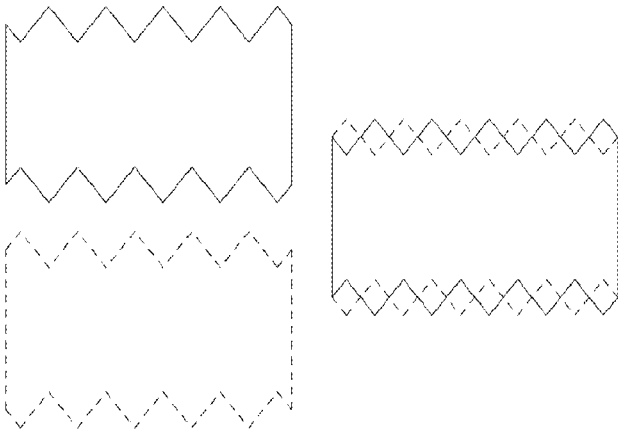

In this example, the trays 92 may also be nestable for shipping in a compact shape, as is shown in FIGS. 9H and 9J, but also stackable during use as shown in the example of FIGS. 9G and 9I. By rotating one tray, such as by 180 degrees, it can be stacked on another tray, allowing two trays to be carried in one hand for example. In the example as shown, the trays include scallops 91 on the edges that are placed such that when a tray is rotated 180 degrees from its nested position, they will become mis-aligned by half the width of a scallop, while still engaging one another at sides of the trays to allow positive engagement between stacked adjacent trays. Although scallops 91 are shown, other suitable structures, such as ribs, or even more general curvatures or rectilinear structures that allow nesting in one direction and stacking in a rotated direction are contemplated. The scallops 91 or other structures can thus be a variety of shapes (sinusoidal, square, wave, etc.) As shown in FIG. 9I, the structures may be larger, such as formed from curved side walls instead of smaller scallops or the like. These larger structures remain nestable, as is shown in FIG. 9J. Indents may be provided along the base perimeter that align with a stacked adjacent tray's scallops (when rotated) and keep the trays from sliding apart when stacked. Though the trays shown in this example are rectangular, if the tray is square, it could be configured to stack by rotating 90 degrees for example. It should be recognized that such an approach would apply for all even polygons, which can be rotated until the sides line up, with the number of degrees will be 360/(number of sides). For example, where the tray is formed as a pentagon, the user could rotate the pentagon by 72 degrees. As also seen in this example, the corners on opposite sides are made to be different, creating indicator tabs 93*a* (or by general outside shape) that let the user know it has been rotated (such as by 180 degrees). As seen in FIGS. 9K-9M, the pattern of the scallops or the like is explained further. In FIG. 9K, the pattern (such as of the scallops) is non-symmetrical, with the pattern translated upward to the other side, not rotated as is common, and each side is the same without any "offset". In FIG. 9L, the pattern of the scallops or the like are again shown to be symmetrical and are a mirror image of one another, such that the sides are not the same, and the pattern of each is offset by ¼ of pattern's length compared to FIG. 9K. Thus, the top row moves opposite direction of bottom row, or they move together in the combined depiction from their position(s) in FIG. 9K. In the example of FIG. 9M, the pattern is non-symmetrical and the sides are not the same, with the side patterns offset by ⅓ of pattern's length. The top row moves in an opposite direction of bottom row, or they move together in the combined depiction from their position(s) in FIG. 9K. It should be apparent that the offset could be any portion of pattern's length.

Figure 10:
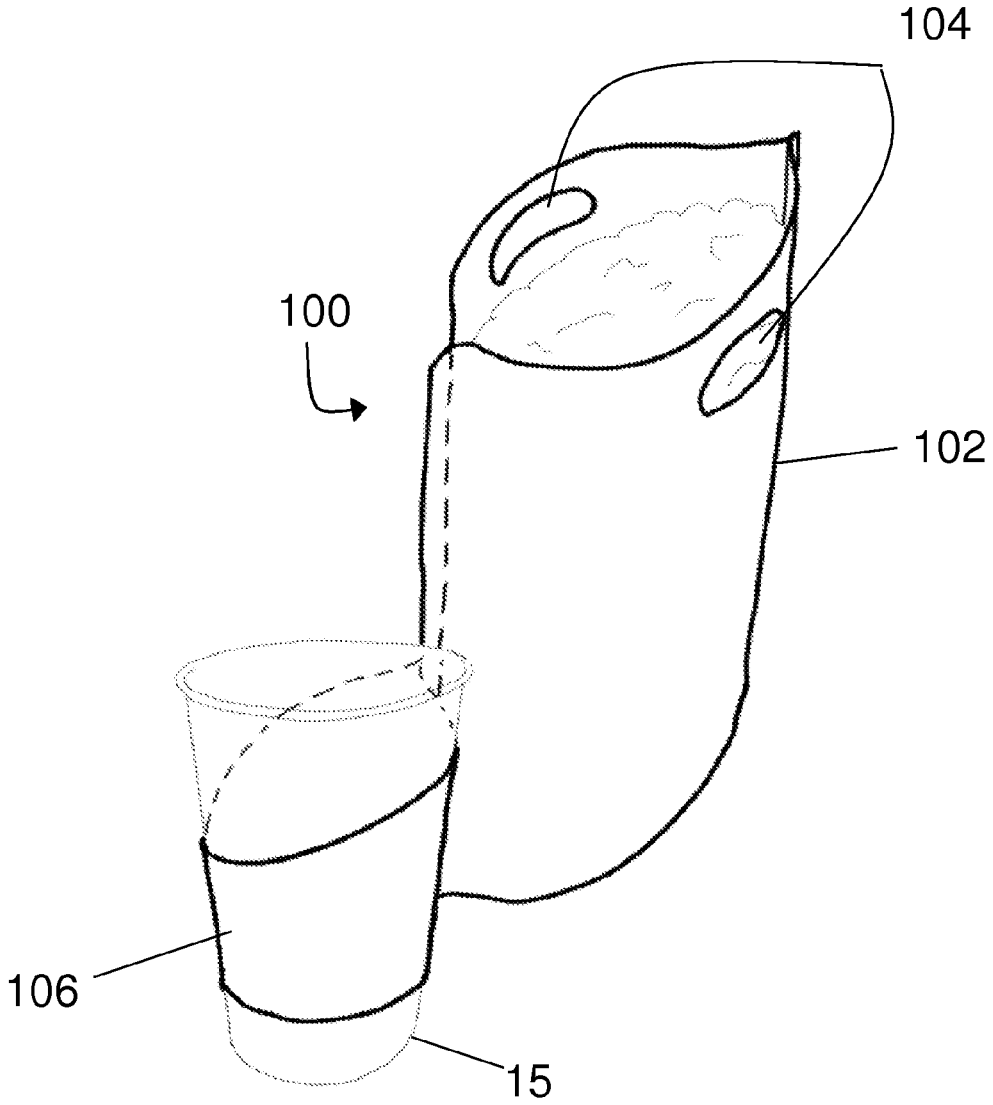
FIG. 10 is a perspective view of a further example of a carrier according to the invention.
Figure 11:
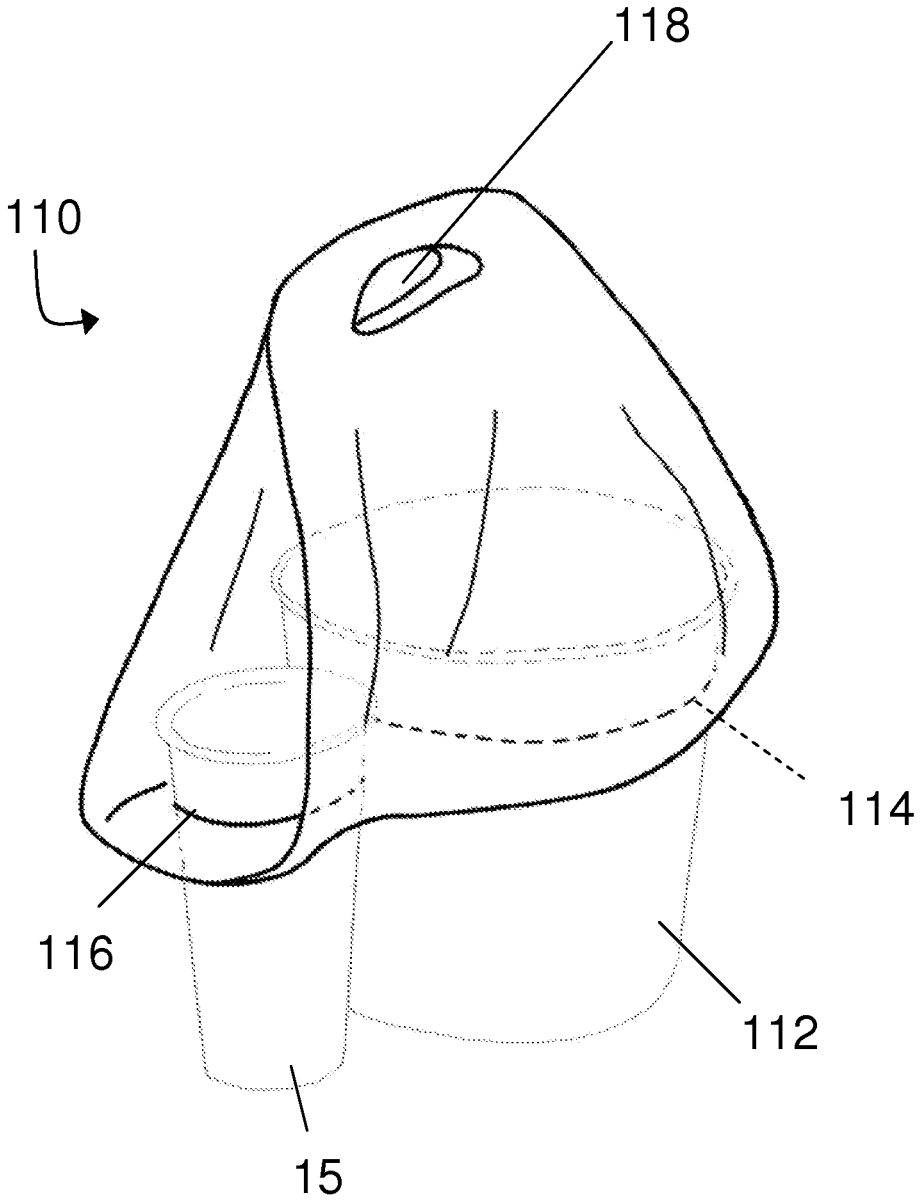
FIG. 11 is a perspective view of a further example of a carrier according to the invention, showing the carrier in a folded state.
Figure 12:
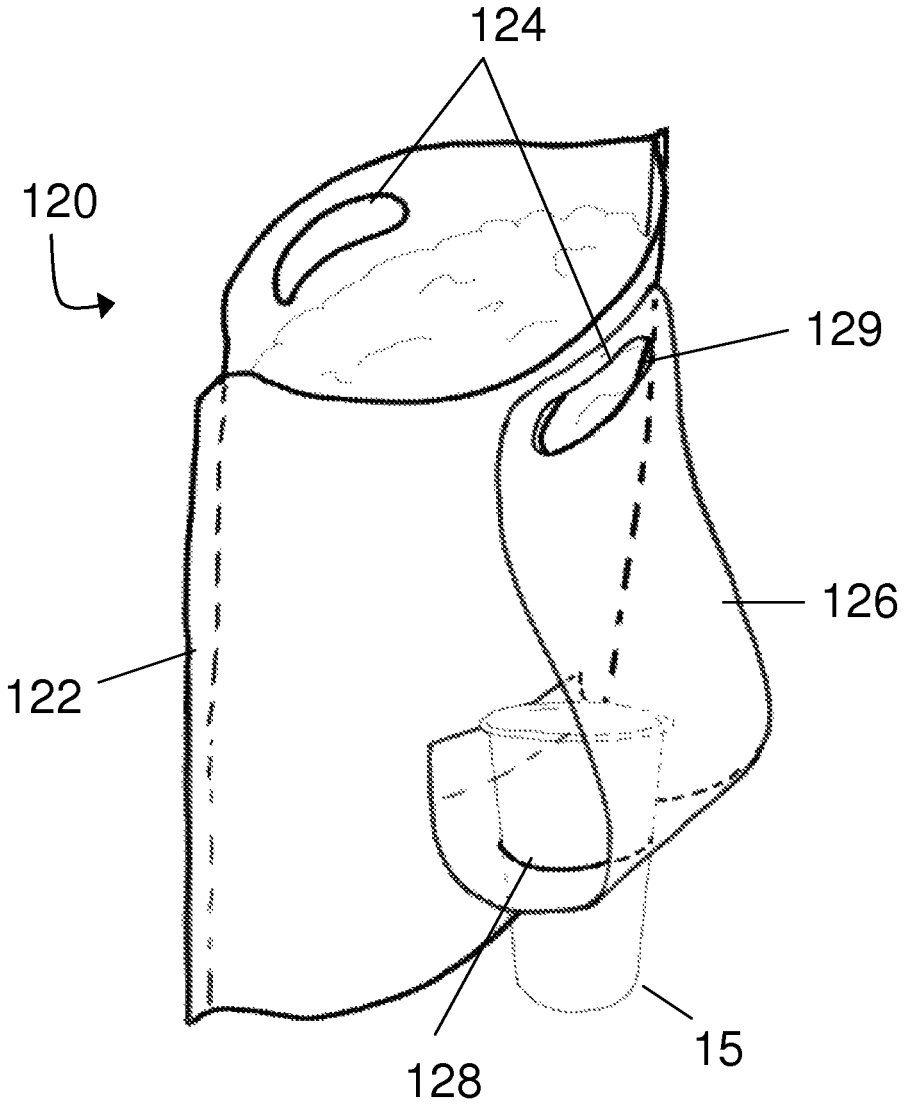
FIG. 12 is a perspective view of a further example of a carrier according to the invention.
Figure 13:
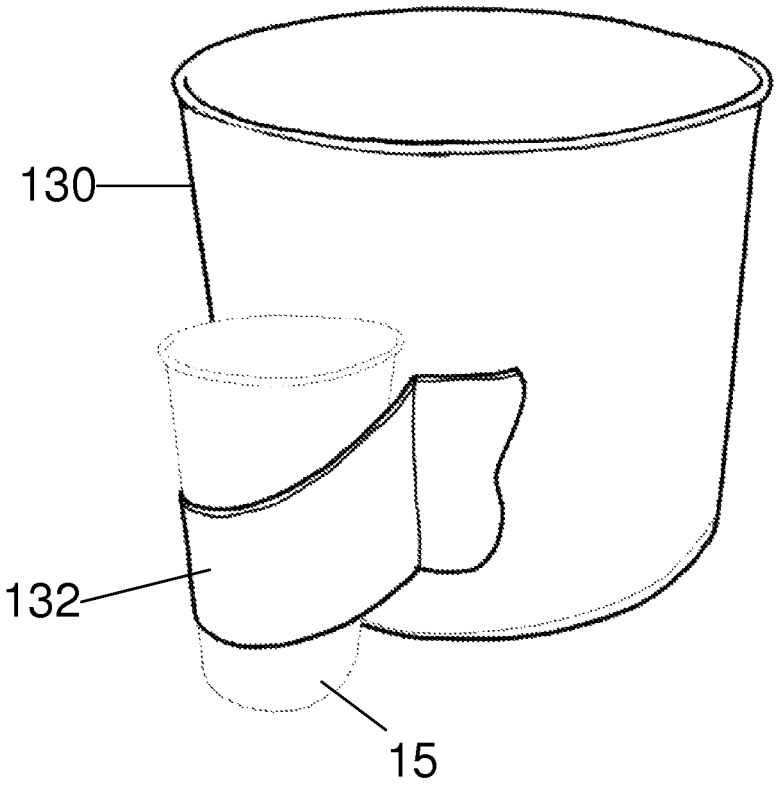
FIG. 13 is a perspective view of a further example of a carrier according to the invention.

Another example is shown in FIG. 10, wherein the carrier 100 is formed to include a pouch portion 102, for food items such as popcorn, peanuts or other items as desired. The portion 102 may be provided with handle portions 104 for carrying the carrier 100. A cup holder portion 106 is also provided with the carrier 100, and may be formed from the same sheet material, and a heat seal formed between the cup holder 106 and pouch 102. The cup holder portion 106 may be a circular sleeve that engages and holds a cup 15 in position as the pouch portion 102 is carried. The sleeve holder 106 may be positioned so that the cup 15 and pouch 102 may be supported on a surface together before being picked up and carried by a user. In use, the pouch 102 may be held by handles 104, or alternatively, the cup 15 and sleeve portion may be held with the pouch 102 supported in an upright position. The tightness of the grip of the web between the sleeve 106 and pouch 102 can be adjusted as the contents in the bag 102 are consumed and more slack is created therebetween. Alternatively, as seen in FIG. 11, a similar arrangement may use a carrier 110, for carrying a container 112 containing popcorn or the like, by means of an aperture 114 formed in carrier 110. Different sized containers 112 may be securely held in aperture 114. A further aperture 116 may be provided for carrying a cup 15 similar to prior examples. Handles 118 may be provided in the sheet material of carrier 110 for carrying both containers 112 and cup 15 with a single hand. A further alternative is shown in FIG. 12, wherein carrier 120 includes a pouch portion 122 for holding popcorn or the like. The pouch portion 122 may have handles 124 for simple carrying. A sheet 126 may be attached on a side of pouch 122. The sheet 126 may have an aperture 128 for holding a cup 15 in association with pouch 122. The sheet 126 may be secured at the bottom portion thereof by a heat seal or the like, with a top portion having a handle 129 formed therein. After positioning of a cup 15 in hole 128, the sheet 126 may then be folded to the position shown, wherein the handle portion 129 is positioned to be aligned with the handles 124 for carrying cup 15 along with pouch 122. The sheet may position the cup 15 such that the pouch 122 can be supported on a surface with cup 15 also supported on the surface. Yet a further alternative is shown in FIG. 13, wherein a container 130 includes a carrier 132, such as for a cup 15. The container 130 may be used for popcorn or the like, with carrier 132 provided to allow a beverage to be carried with the container 130. The carrier 132 may be a paper or plastic sheet attached to a side of container 130 to form a loop or sling for carrying cup 15.

Figure 14:
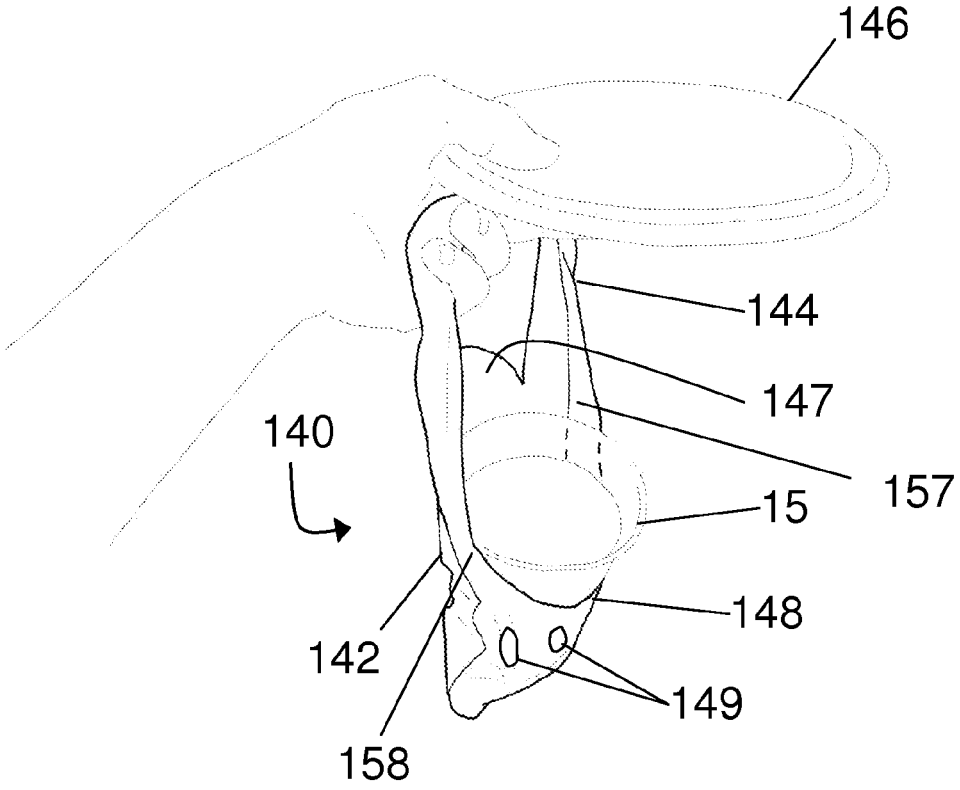
FIG. 14 is a perspective view of a further example of a carrier according to the invention, shown being carried by a user.

Other environments and applications may require carrying different articles or items, such as a buffet or picnic type environment or the like, where a user may typically have a plate of food and also a drink, making it difficult to handle both easily. In FIG. 14, a carrier 140 may be formed of sheets sealed or adhered together at the sides and bottom to form a pouch 142 for receiving a beverage cup 15. Alternatively, it should be recognized that the carrier 140 and pouch 142 may be used to carry other beverage containers, such as cans or bottles (plastic or glass). The carrier 140 further has a handle portion 144 formed as an open loop above the pouch 142. The handle portion 144 may be simply grasped by one or more fingers or the palm of the hand, to thereby support the beverage for carrying or consumption while leaving the rest of the hand free to also carry a plate 146, for example. In this manner, the user has access to both the beverage cup 15 and the items on plate 146 with their free hand, facilitating handling of these items and consumption thereof. In the example shown in FIG. 14, the carrier 140 may be provided with a back side 147 having a greater height to facilitate securing the cup 15, or a can or bottle therein. The high back 147 further gives the user something to push against (tactile feedback) as a drink is being inserted into pouch 142, and prevents overshooting the carrier. The top of the back side 147 also may be formed such that it will bow outward when a beverage is contained in the pouch 142 when hanging, due to the gravity load of the drink, thereby keeping it out of user's way when not actively accessing the drink, such as when walking or standing or transporting the drink. A front side 148 may be formed with a lower height which allows the user to grab the drink easily while it is supported in the pouch 142. The configuration of pouch 142 may also be provided such that the space between sides 147 and 148 is dimensioned to make a large target for the user to insert the beverage container. The shape of the pouch 142 may also effectively pinch in center creating a concave "waist" that helps to hold beverages using pressure from the sides 157 and 158. If a user has a beverage bottle, cup, or can they can be pushed inside the "waist", leaning the beverage bottle, cup or can backward slightly, toward 147 for a more secure hold, or positioned outside, leaning forward slightly toward 148 for better user access while actively consuming the beverage. There may also be holes or slits 149 in the back side 147 and/or front side 148 to prevent beverage from sticking to film from which the carrier 140 may be constructed. The holes/slits 149 may be strategically located to give relief where needed most. In use, the carrier 140 with a beverage container positioned therein hangs nearly vertical because the flexible material from which the carrier 140 may be constructed auto-orients, thereby enabling open-top cups 15, or open bottles or cans not to spill.

Figure 14A:
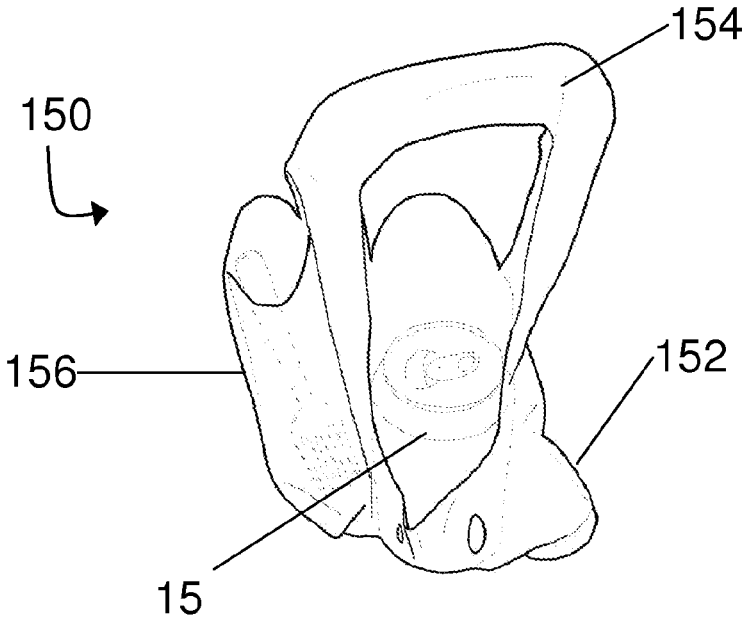
FIG. 14A is a perspective view of a further example of a carrier according to the invention, similar to the example of FIG. 14.

In another example of the invention as shown in FIG. 14A a carrier 150 may be provided which can also be used to facilitate handling of beverages and other items in various environments, such as in the prior example. The carrier 150 may be formed of sheets sealed together at the sides and bottom to form a pouch 152 for receiving a beverage 15. The carrier 150 further has a handle portion 154 formed as an open loop above the pouch 152. The handle portion 154 may be simply grasped by one or more fingers or the palm of the hand, to thereby support the beverage for carrying or consumption while leaving the rest of the hand free to also carry a plate for example, similar to the example of FIG. 14. In this example, the carrier may further comprise a separate pocket portion 156, which may be used to store and carry utensils, a napkin, condiments or other items as may be desired. If desired, the carrier 150 may be prepackaged with utensils and/or a napkin, straw, crayons for coloring, condiments or other items as may be desired.

Figure 15:
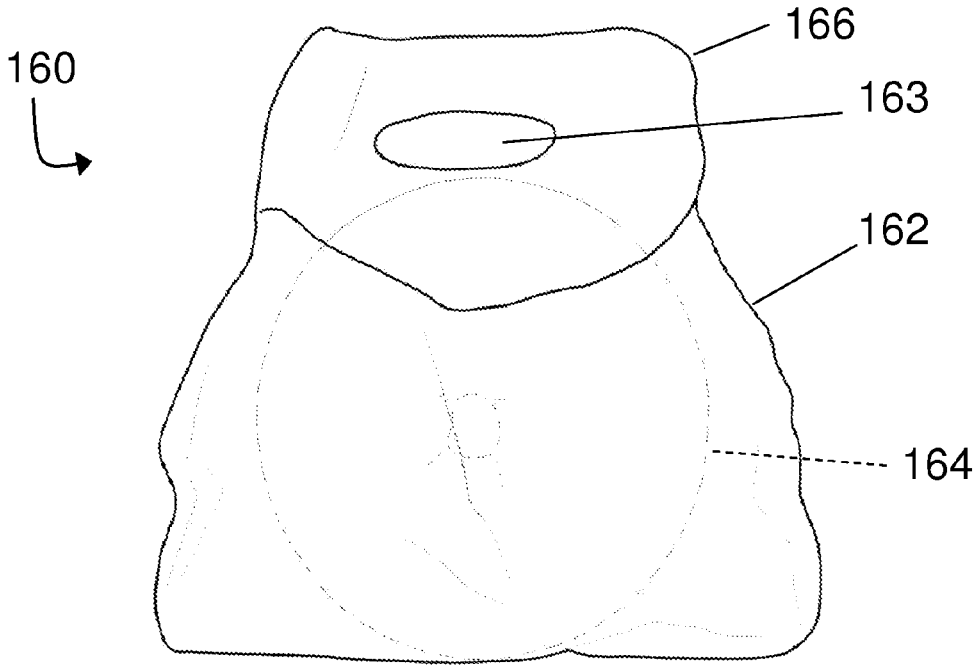
FIG. 15 is a front view of a further example of a carrier according to the invention.
Figure 15A:
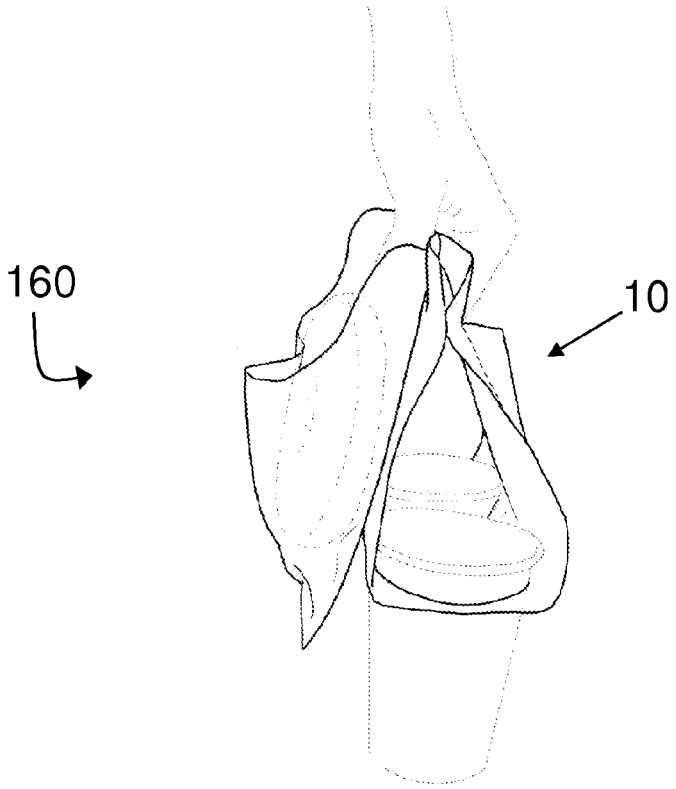
FIG. 15A is a perspective view of the carrier shown in FIG. 15 in use with a further carrier example according to the invention, such as the carrier of FIG. 1, both being carried by a user.

In a further example as shown in FIG. 15, a carrier 160 is designed to facilitate the handling of food and drink items in environments such as a donut or pastry shop, coffee houses or the like, where users typically purchase coffee or like beverages along with a donut, pastry, bagel, muffin or the like. The carrier 160 therefore may be formed of sheets sealed together at the sides and bottom to form a pouch 162 for receiving a donut, pastry, muffin or the like 164. The carrier 160 further has a handle portion 163 formed as an open loop above the pouch 162 in an upper portion 166. The handle portion 163 may be simply grasped by one or more fingers or the palm of the hand, to thereby support the item contained therein for carrying and/or consumption while leaving the rest of the hand free to also carry other items, such a cup of coffee or for allowing use of the hand for other purposes. In FIG. 15A, to facilitate carrying both food items as well as beverages, the carrier 160 may be used in association with a beverage carrier such as described in FIG. 1 for example, or these can be integrated into a single carrier for example. As shown in FIG. 15, the carrier 160 may be formed of two layers of a film that are sealed around perimeter of pouch, with one layer acting as a pocket with a curved upper edge similar to the food items that may be carried thereby. The carrier 160, similar to prior examples, provides convenience of carrying a pastry, bagel, donut, brownie, etc., in an economical and compact solution. Alternatively, a three layer, dual pocket version could be offered that would offer a barrier between food types.

Figure 16:
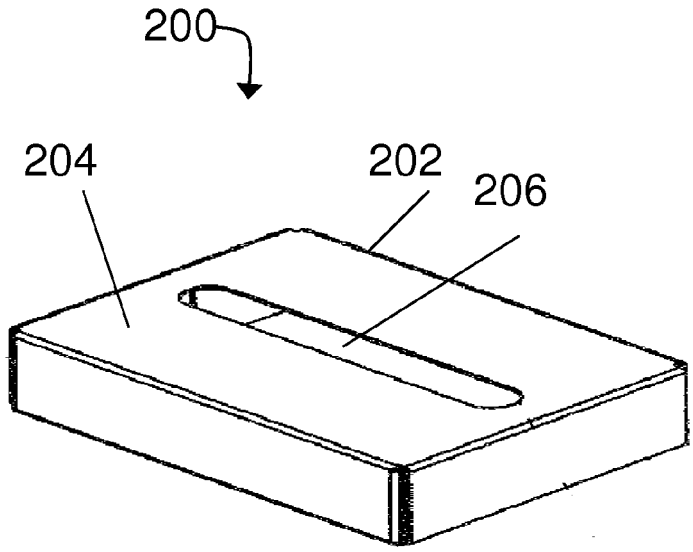
FIG. 16 is a perspective view of a first example of a dispensing system for a plurality of carriers for carrying beverage containers.
Figure 17:
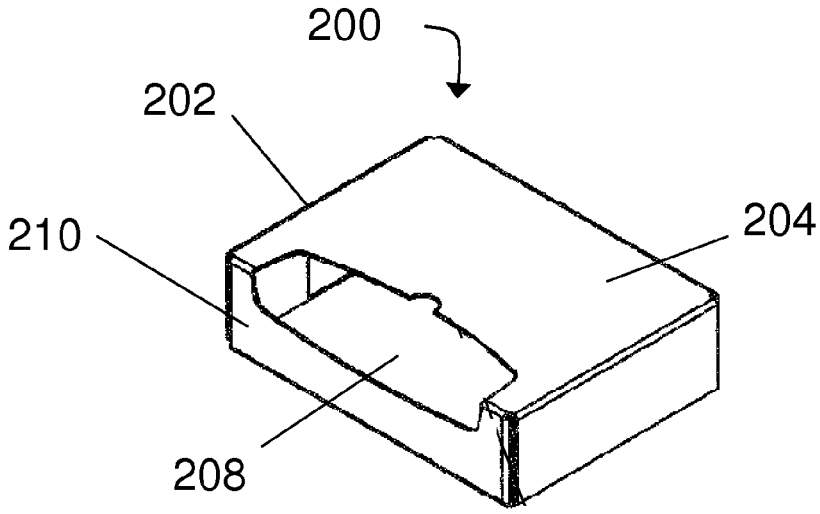
FIG. 17 is a perspective view of a second example of a dispensing system for a plurality of carriers for carrying beverage containers.

In another aspect of the invention, a dispensing system 200 for carrier examples according to the invention is provided, as shown in FIGS. 16 and 17, which can have any suitable shape corresponding to the particular carriers to be dispensed therefrom. In one example, the dispenser is a rectangular box which may hold any desired number of carriers therein. The dispensing system 200 may include a box body 202 made out of any suitable material such as flat cardboard, plastic, or any suitable material for example. The dispensing system 200 contains a plurality of carriers in a folded, interleaved configuration, and each carrier therein may be dispensed individually in a similar fashion to tissues for example, wherein the removal of one carrier advances or pulls along the next carrier to a position for subsequent removal. As should be recognized, the dispenser 200 allows a number of carriers to be conveniently stored for use, with a very small footprint, so as not to use much space in a storage area. The nature of the carriers being formed of lightweight flexible film or the like, and the dispenser, allow for simple, and cost-effective shipping and transport of the carriers for subsequent use. The dispenser 200 also facilitates use in many different retail environments, by providing a plurality of dispensing openings and positions, allowing the box body 202 to be positioned on a flat surface for dispensing or in an upright position on a shelf for example.

As shown in these FIGS., at least one of the sides of box body 202, such as at least the top side 204, may include a dispensing opening 206. In one example, opening 206 is located at an intermediate portion of the top (and/or bottom) wall 204 of dispensing system 200. The opening 206 may be created by the removal of a panel (not shown), the panel being formed by perforations (not shown) in the wall of box body 202. At first use, the perforated panel over opening 206 is selectively removed for access to the carriers therein. The dispensing opening 206 may be used to dispense carriers when the box 202 is supported on a flat surface in the position shown, such as a countertop.

In the same dispenser 200, or provided separately if desired, an alternative dispensing opening 208 may be provided, which is formed between the intersection of the top (or bottom) wall 204 and one or more sides 210 of the box 202. In a preferred example for instance, several side openings 208 may be provided along different sides of the box 202, thereby providing flexibility in accessing the carriers therein. The opening(s) 208 may again be closed by a perforated panel until use is desired. The side opening(s) 208 allow dispensing of carriers when the box 202 is positioned in an upright manner on a shelf for example, thereby avoiding use of countertop space if desired. It should also be recognized that the side opening 208 could be formed along the intersection of the top (or bottom) wall 204 and an end side wall of the box 202 if desired, again providing flexibility in positioning and use of the dispenser 200. The dispenser therefore provides the ability to dispense individual carriers through the sides or the middle, offering widely varied shelves, counters and serving surfaces to be used. Alternatively, instead of interleaved carriers inside box 202, first laying a 200- or 250-quantity (or other quantity) stack of carriers flat, then folding the stack of carriers in half, before insertion into the dispenser may be desired. The unfolded carriers when flat measure approximately 24 inches by 11 inches, but alternatively can be made larger or smaller. After folding in half the carriers will be resemble a square shape as seen from above and will measure approximately 13 inches by 11 inches by approximately 2.5 inches tall. This stack will then be placed inside an inner box 202. Alternatively, four or five smaller 50-quantity stacks of carriers can be folded in half and stacked atop one another, then placed in the box. Approximately four or five folded stacks of 50 carriers, totaling 200 or 250 carriers may be placed in the box, rendering a convenient weight, package size, and carrier quantity. These inner dispensing boxes then can be put into a larger master box holding approximately 4 or 6 inner boxes of convenient weight or size. The fold of the carriers or one of the adjacent sides will face the opening 208 enabling the person dispensing the carriers to grasp with their fingers and pull from the box the outermost carrier or any exposed edge of carriers in the stack or stacks of folded carriers. As the folded carrier is consumed, the next lower folded carrier can be consumed, and so forth until all carriers are consumed from the carton.

Based upon the foregoing disclosure, it should now be apparent that the beverage and food carrying apparatus and dispensing systems as described herein will carry out the objects set forth hereinabove. It is, therefore, to be understood that any variations evident fall within the scope of the claimed invention and thus, the selection of specific component elements can be determined without departing from the spirit of the invention herein disclosed and described.

What is claimed is:

1. A tray for carrying food product comprising a tray body having a bottom and side portions together forming a compartment in which liquid can be contained, wherein the tray is nestable with like trays for shipping and storage, and also stackable during use, wherein the tray is nestable with other trays when in a first orientation, and stackable when rotated with respect to another tray, thereby allowing two or more trays to be carried in one hand or stacked on a support surface, and wherein the tray includes a retaining structure on the bottom surface of the tray body for abutting a top portion of at least one associated beverage container, the retaining structure including male or female structures having an arcuate shape for at least partially surrounding the top portion of the at least one associated beverage container when the bottom of the tray body is rested thereupon, whereby movement of the tray relative to the at least one associated beverage container is restricted, the male or female structures including at least two half moon structures spaced apart for aligning with respective outer portions of two associated beverage containers placed in close proximity in a side-by-side configuration, and at least two middle arcs positioned between the half moon structures for aligning with opposite sides of a single associated beverage container.

2. The tray according to claim 1, wherein the side portions have structures which are aligned with structures in another tray for nesting and misaligned when rotated for stacking.

3. The tray according to claim 1, wherein the retaining structure comprises grooves configured to receive the top portion of the associated at least one container.

4. The tray according to claim 1, wherein the retaining structure comprises structure that surrounds the top rim of the associated at least one container.

5. The tray according to claim 4, wherein the retaining structure includes an undercut that is configured to positively attach to a cup lip of the associated at least one container.

6. The tray according to claim 1, wherein the bottom of the tray has projecting portions or grooves that abuttingly engage an upper open end of the associated at least one container.

7. The tray according to claim 1, wherein the tray has side walls having a convex or concave shape that allow a user to grip the tray.

8. The tray according to claim 1, wherein the tray has at least one platform area to facilitate grasping and supporting the tray.

9. The tray according to claim 1, wherein the tray is formed to be nestable with other trays for shipping in a compact shape.

10. The tray according to claim 1, wherein the tray is formed to be stackable by rotating one tray relative to another tray.

11. The tray according to claim 10, wherein the tray includes structure to provide positive engagement between stacked adjacent trays.

12. The tray according to claim 1, wherein the tray is formed to be nestable with other trays and stackable by rotating one tray relative to another tray.

13. The tray according to claim 1, wherein the bottom of the tray body has a generally rectangular footprint, and wherein the retaining structure is spaced apart from an outer periphery of the bottom such that the retaining structure does not interfere with the nesting or stacking of like trays.

14. The tray according to claim 1, wherein the arcuate shape at least partially defines a circular region having a continuous surface adapted to abutingly engage an upper portion of the associated at least one beverage container.

15. The tray according to claim 1, wherein the half moon structures are aligned along a longitudinal axis of the tray, and the middle arcs are aligned along a central transverse axis of the tray between the half moon structures.

16. The tray according to claim 15, wherein the bottom surface of the tray includes a beverage container engaging surface that is above the bottom extent of the tray, whereby a lip of an associated beverage container touches the bottom surface of the tray above the bottom extent of the tray when the tray is placed thereupon.

* * * * *